US010278897B2

(12) United States Patent
David et al.

(10) Patent No.: US 10,278,897 B2
(45) Date of Patent: May 7, 2019

(54) DUAL VIAL ADAPTER ASSEMBLAGE INCLUDING DRUG VIAL ADAPTER WITH SELF-SEALING ACCESS VALVE

(71) Applicant: West Pharma. Services IL, Ltd., Ra'anana (IL)

(72) Inventors: Uri David, Nes Ziona (IL); Igor Denenburg, Gedera (IL); Elisheva Fabrikant, Herzliya (IL)

(73) Assignee: West Pharma. Services IL, Ltd., Ra'anana (IL)

( * ) Notice: Subject to any disclaimer, the term of this patent is extended or adjusted under 35 U.S.C. 154(b) by 0 days.

(21) Appl. No.: 15/775,250

(22) PCT Filed: Nov. 24, 2016

(86) PCT No.: PCT/IL2016/051265
§ 371 (c)(1),
(2) Date: May 10, 2018

(87) PCT Pub. No.: WO2017/090042
PCT Pub. Date: Jun. 1, 2017

(65) Prior Publication Data

US 2018/0325775 A1 Nov. 15, 2018

(30) Foreign Application Priority Data

Nov. 25, 2015 (IL) ..... 242776
May 15, 2016 (IL) ..... 245641

(51) Int. Cl.
*A61J 1/20* (2006.01)

(52) U.S. Cl.
CPC ..... *A61J 1/2089* (2013.01); *A61J 1/2013* (2015.05); *A61J 1/2037* (2015.05); *A61J 1/2051* (2015.05); *A61J 1/2096* (2013.01)

(58) Field of Classification Search
CPC combination set(s) only.
See application file for complete search history.

(56) References Cited

U.S. PATENT DOCUMENTS 62,333 A 2/1867 Holl
247,975 A 10/1881 Wickes
(Continued)

FOREIGN PATENT DOCUMENTS

CN 1636605 A 7/2005
CN 1747683 A 3/2006
(Continued)

OTHER PUBLICATIONS

Grifols Vial Adapter Product Literature, 2 pages, Jan. 2002.
(Continued)

*Primary Examiner* — Philip R Wiest
(74) *Attorney, Agent, or Firm* — Panitch Schwarze Belisario & Nadel LLP

(57) ABSTRACT

Dual vial adapter assemblage modified including a drug vial adapter having a female connector fitted with a normally closed needlefree swabable self-sealing access valve, a liquid vial adapter with a male connector and a manually operable flow control arrangement. The flow control arrangement has three operative positions including an initial extended set-up position, an intermediate compacted flow communication position and a final detachment position for separating the drug vial adapter and the liquid vial adapter. The liquid vial adapter and the drug vial adapter are engaged in the initial extended set-up position and the intermediate compacted flow communication position. The self-sealing access valve is closed in the initial extended set-up position and compressed open in the intermediate compacted flow communication position.

10 Claims, 22 Drawing Sheets

(56) References Cited

U.S. PATENT DOCUMENTS

| | | | |
|---|---|---|---|
| 254,444 | A | 2/1882 | Vogel |
| 300,060 | A | 6/1884 | Ford |
| 1,021,681 | A | 3/1912 | Jennings |
| 1,704,817 | A | 3/1929 | Ayers |
| 1,930,944 | A | 10/1933 | Schmitz, Jr. |
| 2,326,490 | A | 8/1943 | Perelson |
| 2,560,162 | A | 7/1951 | Garwood |
| 2,748,769 | A | 6/1956 | Huber |
| 2,830,587 | A | 4/1958 | Everett |
| 2,931,668 | A | 4/1960 | Baley |
| 2,968,497 | A | 1/1961 | Treleman |
| 3,059,643 | A | 10/1962 | Barton |
| D198,499 | S | 6/1964 | Harautuneian |
| 3,225,763 | A | 12/1965 | Waterman |
| 3,277,893 | A | 10/1966 | Clark |
| 3,308,822 | A | 3/1967 | De Luca |
| 3,484,849 | A | 12/1969 | Huebner et al. |
| 3,618,637 | A | 11/1971 | Santomieri |
| 3,757,981 | A | 9/1973 | Harris, Sr. et al. |
| 3,782,365 | A | 1/1974 | Pinna |
| 3,788,524 | A | 1/1974 | Davis et al. |
| 3,822,700 | A | 7/1974 | Pennington |
| 3,826,261 | A | 7/1974 | Killinger |
| 3,872,992 | A | 3/1975 | Larson |
| 3,885,607 | A | 5/1975 | Peltier |
| 3,938,520 | A | 2/1976 | Scislowicz et al. |
| 3,957,052 | A | 5/1976 | Topham |
| 3,977,555 | A | 8/1976 | Larson |
| 3,993,063 | A | 11/1976 | Larrabee |
| 4,020,839 | A | 5/1977 | Klapp |
| 4,026,128 | A | 5/1977 | Blanco |
| 4,051,852 | A | 10/1977 | Villari |
| D247,975 | S | 5/1978 | Luther |
| D248,568 | S | 7/1978 | Ismach |
| 4,109,670 | A | 8/1978 | Slagel |
| 4,121,585 | A | 10/1978 | Becker, Jr. |
| 4,161,178 | A | 7/1979 | Genese |
| 4,187,848 | A | 2/1980 | Taylor |
| D254,444 | S | 3/1980 | Levine |
| 4,203,067 | A | 5/1980 | Fitzky et al. |
| 4,203,443 | A | 5/1980 | Genese |
| 4,210,173 | A | 7/1980 | Choksi et al. |
| D257,286 | S | 10/1980 | Folkman |
| 4,253,501 | A | 3/1981 | Ogle |
| 4,296,786 | A | 10/1981 | Brignola |
| 4,303,067 | A | 12/1981 | Connolly et al. |
| 4,312,349 | A | 1/1982 | Cohen |
| 4,314,586 | A | 2/1982 | Folkman |
| 4,328,802 | A | 5/1982 | Curley et al. |
| 4,335,717 | A | 6/1982 | Bujan et al. |
| D267,199 | S | 12/1982 | Koenig |
| 4,376,634 | A | 3/1983 | Prior et al. |
| D268,871 | S | 5/1983 | Benham et al. |
| 4,392,850 | A | 7/1983 | Elias et al. |
| D270,282 | S | 8/1983 | Gross |
| 4,410,321 | A | 10/1983 | Pearson et al. |
| 4,411,662 | A | 10/1983 | Pearson |
| D271,421 | S | 11/1983 | Fetterman |
| 4,434,823 | A | 3/1984 | Hudspith |
| 4,465,471 | A | 8/1984 | Harris et al. |
| 4,475,915 | A | 10/1984 | Sloane |
| 4,493,348 | A | 1/1985 | Lemmons |
| 4,505,709 | A | 3/1985 | Froning et al. |
| 4,507,113 | A | 3/1985 | Dunlap |
| D280,018 | S | 8/1985 | Scott |
| 4,532,969 | A | 8/1985 | Kwaan |
| 4,564,054 | A | 1/1986 | Gustavsson |
| 4,573,993 | A | 3/1986 | Hoag et al. |
| 4,576,211 | A | 3/1986 | Valentini et al. |
| 4,581,014 | A | 4/1986 | Millerd et al. |
| 4,585,446 | A | 4/1986 | Kempf |
| 4,588,396 | A | 5/1986 | Stroebel et al. |
| 4,588,403 | A | 5/1986 | Weiss et al. |
| D284,603 | S | 7/1986 | Loignon |
| 4,604,093 | A | 8/1986 | Brown et al. |
| 4,607,671 | A | 8/1986 | Aalto et al. |
| 4,614,437 | A | 9/1986 | Buehler |
| 4,638,975 | A | 1/1987 | Iuchi et al. |
| 4,639,019 | A | 1/1987 | Mittleman |
| 4,667,927 | A | 5/1987 | Oscarsson |
| 4,675,020 | A | 6/1987 | McPhee |
| 4,676,530 | A | 6/1987 | Nordgren et al. |
| 4,683,975 | A | 8/1987 | Booth et al. |
| 4,697,622 | A | 10/1987 | Swift et al. |
| 4,721,133 | A | 1/1988 | Sundblom |
| 4,729,401 | A | 3/1988 | Raines |
| 4,735,608 | A | 4/1988 | Sardam |
| 4,743,229 | A | 5/1988 | Chu |
| 4,743,243 | A | 5/1988 | Vaillancourt |
| 4,752,292 | A | 6/1988 | Lopez et al. |
| 4,758,235 | A | 7/1988 | Tu |
| 4,759,756 | A | 7/1988 | Forman et al. |
| 4,778,447 | A | 10/1988 | Velde et al. |
| 4,787,898 | A | 11/1988 | Raines |
| 4,797,898 | A | 1/1989 | Martinez |
| D300,060 | S | 2/1989 | Molgaard-Nielsen |
| 4,804,366 | A | 2/1989 | Zdeb et al. |
| 4,826,492 | A | 5/1989 | Magasi |
| 4,832,690 | A | 5/1989 | Kuu |
| 4,834,152 | A | 5/1989 | Howson et al. |
| D303,013 | S | 8/1989 | Konopka |
| 4,857,062 | A | 8/1989 | Russell |
| 4,865,592 | A | 9/1989 | Rycroft |
| 4,871,463 | A | 10/1989 | Taylor et al. |
| 4,898,209 | A | 2/1990 | Zbed |
| 4,909,290 | A | 3/1990 | Coccia |
| 4,919,596 | A | 4/1990 | Slate et al. |
| 4,927,423 | A | 5/1990 | Malmborg |
| 4,931,040 | A | 6/1990 | Haber et al. |
| 4,932,944 | A | 6/1990 | Jagger et al. |
| 4,967,797 | A | 11/1990 | Manska |
| D314,050 | S | 1/1991 | Sone |
| D314,622 | S | 2/1991 | Andersson et al. |
| 4,997,430 | A | 3/1991 | Van der Heiden et al. |
| 5,006,114 | A | 4/1991 | Rogers et al. |
| 5,035,686 | A | 7/1991 | Crittenden et al. |
| 5,041,105 | A | 8/1991 | D'Alo et al. |
| 5,045,066 | A | 9/1991 | Scheuble et al. |
| 5,049,129 | A | 9/1991 | Zdeb et al. |
| 5,053,015 | A | 10/1991 | Gross |
| 5,061,248 | A | 10/1991 | Sacco |
| 5,088,996 | A | 2/1992 | Kopfer et al. |
| 5,096,575 | A | 3/1992 | Cosack |
| 5,104,387 | A | 4/1992 | Pokorney et al. |
| 5,113,904 | A | 5/1992 | Aslanian |
| 5,122,124 | A | 6/1992 | Novacek et al. |
| 5,125,908 | A | 6/1992 | Cohen |
| 5,125,915 | A | 6/1992 | Berry et al. |
| D328,788 | S | 8/1992 | Sagae et al. |
| 5,171,230 | A | 12/1992 | Eland et al. |
| 5,201,705 | A | 4/1993 | Berglund et al. |
| 5,201,717 | A | 4/1993 | Wyatt et al. |
| 5,203,771 | A | 4/1993 | Melker et al. |
| 5,203,775 | A | 4/1993 | Frank et al. |
| 5,211,638 | A | 5/1993 | Dudar et al. |
| 5,232,029 | A | 8/1993 | Knox et al. |
| 5,232,109 | A | 8/1993 | Tirrell et al. |
| 5,242,432 | A | 9/1993 | DeFrank |
| 5,247,972 | A | 9/1993 | Tetreault |
| D341,420 | S | 11/1993 | Conn |
| 5,269,768 | A | 12/1993 | Cheung |
| 5,270,219 | A | 12/1993 | DeCastro et al. |
| 5,279,576 | A | 1/1994 | Loo et al. |
| 5,288,290 | A | 2/1994 | Brody |
| 5,300,034 | A | 4/1994 | Behnke et al. |
| 5,301,685 | A | 4/1994 | Guirguis |
| 5,304,163 | A | 4/1994 | Bonnici et al. |
| 5,304,165 | A | 4/1994 | Haber et al. |
| 5,308,483 | A | 5/1994 | Sklar et al. |
| 5,312,377 | A | 5/1994 | Dalton |
| 5,328,474 | A | 7/1994 | Raines |
| D349,648 | S | 8/1994 | Tirrell et al. |
| 5,334,163 | A | 8/1994 | Sinnett |
| 5,334,179 | A | 8/1994 | Poli et al. |

(56) References Cited

U.S. PATENT DOCUMENTS 5,342,346 A 8/1994 Honda et al.
5,344,417 A 9/1994 Wadsworth, Jr.
5,348,544 A 9/1994 Sweeney et al.
5,348,548 A 9/1994 Meyer et al.
5,350,372 A 9/1994 Ikeda et al.
5,364,386 A 11/1994 Fukuoka et al.
5,364,387 A 11/1994 Sweeney
5,374,264 A 12/1994 Wadsworth, Jr.
5,385,547 A 1/1995 Wong et al.
5,397,303 A 3/1995 Sancoff et al.
D357,733 S 4/1995 Matkovich
5,429,614 A 7/1995 Fowles et al.
5,433,330 A 7/1995 Yatsko et al.
5,445,630 A 8/1995 Richmond
5,445,631 A 8/1995 Uchida
D362,718 S 9/1995 Deily et al.
5,451,374 A 9/1995 Molina
5,454,805 A 10/1995 Brony
5,464,111 A 11/1995 Vacek et al.
5,464,123 A 11/1995 Scarrow
5,466,219 A 11/1995 Lynn et al.
5,466,220 A 11/1995 Brenneman
5,470,327 A 11/1995 Helgren et al.
5,471,994 A 12/1995 Guirguis
5,472,022 A 12/1995 Michel et al.
5,478,337 A 12/1995 Okamoto et al.
5,482,446 A 1/1996 Williamson et al.
5,492,147 A 2/1996 Challender et al.
5,496,274 A 3/1996 Graves et al.
D369,406 S 4/1996 Niedospial et al.
5,505,714 A 4/1996 Dassa et al.
5,509,433 A 4/1996 Paradis
5,515,871 A 5/1996 Bittner et al.
5,520,659 A 5/1996 Hedges
5,526,853 A 6/1996 McPhee et al.
5,527,306 A 6/1996 Haining
5,531,695 A 7/1996 Swisher
5,547,471 A 8/1996 Thompson et al.
5,549,577 A 8/1996 Siegel et al.
5,554,128 A 9/1996 Hedges
5,562,686 A 10/1996 Sauer et al.
5,562,696 A 10/1996 Nobles et al.
5,566,729 A 10/1996 Grabenkort et al.
5,569,191 A 10/1996 Meyer
5,573,281 A 11/1996 Keller
5,578,015 A 11/1996 Robb
5,583,052 A 12/1996 Portnoff et al.
5,584,819 A 12/1996 Kopfer
5,591,143 A 1/1997 Trombley, III et al.
5,603,706 A 2/1997 Wyatt et al.
5,607,439 A 3/1997 Yoon
5,611,576 A 3/1997 Guala
5,616,203 A 4/1997 Stevens
5,636,660 A 6/1997 Pfleiderer et al.
5,637,101 A 6/1997 Shillington
5,641,010 A 6/1997 Maier
5,645,538 A 7/1997 Richmond
5,647,845 A 7/1997 Haber et al.
5,651,776 A 7/1997 Appling et al.
5,653,686 A 8/1997 Coulter et al.
5,658,133 A 8/1997 Anderson et al.
5,672,160 A 9/1997 Osterlind et al.
5,674,195 A 10/1997 Truthan
5,676,346 A 10/1997 Leinsing
5,685,845 A 11/1997 Grimard
D388,172 S 12/1997 Cipes
5,699,821 A 12/1997 Paradis
5,702,019 A 12/1997 Grimard
5,718,346 A 2/1998 Weiler
5,728,087 A 3/1998 Niedospial, Jr.
D393,722 S 4/1998 Fangrow, Jr. et al.
5,738,144 A 4/1998 Rogers
5,743,312 A 4/1998 Pfeifer et al.
5,746,733 A 5/1998 Capaccio et al.
5,752,942 A 5/1998 Doyle et al.
5,755,696 A 5/1998 Caizza
5,766,211 A 6/1998 Wood et al.
5,772,630 A 6/1998 Ljungquist
5,772,652 A 6/1998 Zielinski
RE35,841 E 7/1998 Frank et al.
5,776,116 A 7/1998 Lopez et al.
5,782,872 A 7/1998 Muller
5,806,831 A 9/1998 Paradis
5,810,792 A 9/1998 Fangrow, Jr. et al.
5,814,020 A 9/1998 Gross
D399,559 S 10/1998 Molina
5,817,082 A 10/1998 Niedospial, Jr. et al.
5,820,621 A 10/1998 Yale et al.
5,827,262 A 10/1998 Neftel et al.
5,832,971 A 11/1998 Yale et al.
5,833,213 A 11/1998 Ryan
5,834,744 A 11/1998 Risman
5,839,715 A 11/1998 Leinsing
5,853,406 A 12/1998 Masuda et al.
D405,522 S 2/1999 Hoenig et al.
5,868,710 A 2/1999 Battiato et al.
5,871,110 A 2/1999 Grimard et al.
5,873,872 A 2/1999 Thibault et al.
5,879,337 A 3/1999 Kuracina et al.
5,879,345 A 3/1999 Aneas
5,887,633 A 3/1999 Yale et al.
5,890,610 A 4/1999 Jansen et al.
5,891,129 A 4/1999 Daubert et al.
5,893,397 A 4/1999 Peterson et al.
5,897,526 A 4/1999 Vaillancourt
5,899,468 A 5/1999 Apps et al.
5,902,280 A 5/1999 Powles et al.
5,902,298 A 5/1999 Niedospial, Jr. et al.
D410,740 S 6/1999 Molina
5,911,710 A 6/1999 Barry et al.
5,919,182 A 7/1999 Avallone
5,921,419 A 7/1999 Niedospial, Jr. et al.
5,924,584 A 7/1999 Hellstrom et al.
5,925,029 A 7/1999 Jansen et al.
5,935,112 A 8/1999 Stevens et al.
5,941,848 A 8/1999 Nishimoto et al.
5,941,850 A 8/1999 Shah et al.
5,944,700 A 8/1999 Nguyen et al.
5,954,104 A 9/1999 Daubert et al.
5,968,022 A 10/1999 Saito
5,971,181 A 10/1999 Niedospial, Jr. et al.
5,971,965 A 10/1999 Mayer
5,989,237 A 11/1999 Fowles et al.
6,003,566 A 12/1999 Thibault et al.
6,004,278 A 12/1999 Botich et al.
6,019,750 A 2/2000 Fowles et al.
6,022,339 A 2/2000 Fowles et al.
6,036,171 A 3/2000 Weinheimer et al.
6,039,093 A 3/2000 Mrotzek et al.
6,039,302 A 3/2000 Cote, Sr. et al.
D422,357 S 4/2000 Niedospial, Jr. et al.
6,063,068 A 5/2000 Fowles et al.
D427,308 S 6/2000 Zinger
D427,309 S 6/2000 Molina
6,070,623 A 6/2000 Aneas
6,071,270 A 6/2000 Fowles et al.
6,080,132 A 6/2000 Cole et al.
D428,141 S 7/2000 Brotspies et al.
6,086,762 A 7/2000 Guala
6,089,541 A 7/2000 Weinheimer et al.
6,090,091 A 7/2000 Fowles et al.
6,090,093 A 7/2000 Thibault et al.
6,092,692 A 7/2000 Riskin
D430,291 S 8/2000 Jansen et al.
6,099,511 A 8/2000 Devos et al.
6,113,068 A 9/2000 Ryan
6,113,583 A 9/2000 Fowles et al.
6,117,114 A 9/2000 Paradis
D431,864 S 10/2000 Jansen
6,139,534 A 10/2000 Niedospial, Jr. et al.
6,142,446 A 11/2000 Leinsing
6,146,362 A 11/2000 Turnbull et al.
6,149,623 A 11/2000 Reynolds
6,156,025 A 12/2000 Niedospial, Jr. et al.

(56) References Cited

U.S. PATENT DOCUMENTS 6,159,192 A 12/2000 Fowles et al.
6,168,037 B1 1/2001 Grimard
6,171,287 B1 1/2001 Lynn et al.
6,171,293 B1 1/2001 Rowley et al.
6,173,852 B1 1/2001 Browne
6,173,868 B1 1/2001 DeJonge
6,174,304 B1 1/2001 Weston
6,179,822 B1 1/2001 Niedospial, Jr.
6,179,823 B1 1/2001 Niedospial, Jr.
6,206,861 B1 3/2001 Mayer
6,221,041 B1 4/2001 Russo
6,221,054 B1 4/2001 Martin et al.
6,221,065 B1 4/2001 Davis
6,238,372 B1 5/2001 Zinger et al.
6,245,044 B1 6/2001 Daw et al.
D445,501 S 7/2001 Niedospial, Jr.
D445,895 S 7/2001 Svendsen
6,253,804 B1 7/2001 Safabash
6,258,078 B1 7/2001 Thilly
6,280,430 B1 8/2001 Neftel et al.
6,290,688 B1 9/2001 Lopez et al.
6,296,621 B1 10/2001 Masuda et al.
6,299,131 B1 10/2001 Ryan
6,343,629 B1 2/2002 Wessman et al.
6,348,044 B1 2/2002 Coletti et al.
6,358,236 B1 3/2002 DeFoggi et al.
6,364,866 B1 4/2002 Furr et al.
6,378,576 B2 4/2002 Thibault et al.
6,378,714 B1 4/2002 Jansen et al.
6,379,340 B1 4/2002 Zinger et al.
D457,954 S 5/2002 Wallace et al.
6,382,442 B1 5/2002 Thibault et al.
6,386,397 B2 5/2002 Brotspies et al.
6,408,897 B1 6/2002 Laurent et al.
6,409,708 B1 6/2002 Wessman
6,440,107 B1 8/2002 Trombley, III et al.
6,453,949 B1 9/2002 Chau
6,453,956 B2 9/2002 Safabash
6,474,375 B2 11/2002 Spero et al.
6,478,788 B1 11/2002 Aneas
D468,015 S 12/2002 Horppu
6,499,617 B1 12/2002 Niedospial, Jr. et al.
6,503,240 B1 1/2003 Niedospial, Jr. et al.
6,503,244 B2 1/2003 Hayman
6,520,932 B2 2/2003 Taylor
6,524,278 B1 2/2003 Campbell et al.
6,524,295 B2 2/2003 Daubert et al.
D472,316 S 3/2003 Douglas et al.
6,530,903 B2 3/2003 Wang et al.
6,537,263 B1 3/2003 Aneas
D472,630 S 4/2003 Douglas et al.
6,544,246 B1 4/2003 Niedospial, Jr.
6,551,299 B2 4/2003 Miyoshi et al.
6,558,365 B2 * 5/2003 Zinger ..... A61J 1/2089 141/329
6,571,837 B2 6/2003 Jansen et al.
6,572,591 B2 6/2003 Mayer
6,575,955 B2 6/2003 Azzolini
6,581,593 B1 6/2003 Rubin et al.
6,582,415 B1 6/2003 Fowles et al.
D476,731 S 7/2003 Cise et al.
6,591,876 B2 7/2003 Safabash
6,599,273 B1 7/2003 Lopez
6,601,721 B2 8/2003 Jansen et al.
6,626,309 B1 9/2003 Jansen et al.
6,632,201 B1 10/2003 Mathias et al.
6,638,244 B1 10/2003 Reynolds
D482,121 S 11/2003 Harding et al.
D482,447 S 11/2003 Harding et al.
6,651,956 B2 11/2003 Miller
6,652,509 B1 11/2003 Helgren et al.
D483,487 S 12/2003 Harding et al.
D483,869 S 12/2003 Tran et al.
6,656,433 B2 12/2003 Sasso
6,666,852 B2 12/2003 Niedospial, Jr.
6,681,810 B2 1/2004 Weston
6,681,946 B1 1/2004 Jansen et al.
6,682,509 B2 1/2004 Lopez
6,692,478 B1 2/2004 Paradis
6,692,829 B2 2/2004 Stubler et al.
6,695,829 B2 2/2004 Hellstrom et al.
6,699,229 B2 3/2004 Zinger et al.
6,706,022 B1 3/2004 Leinsing et al.
6,706,031 B2 3/2004 Manera
6,715,520 B2 4/2004 Andreasson et al.
6,729,370 B2 5/2004 Norton et al.
6,736,798 B2 5/2004 Ohkubo et al.
6,745,998 B2 6/2004 Doyle
6,746,438 B1 6/2004 Amissolle
6,752,180 B2 6/2004 Delay
D495,416 S 8/2004 Dimeo et al.
D496,457 S 9/2004 Prais et al.
6,802,490 B2 10/2004 Leinsing et al.
6,832,994 B2 12/2004 Niedospial, Jr. et al.
6,852,103 B2 2/2005 Fowles et al.
6,875,203 B1 4/2005 Fowles et al.
6,875,205 B2 4/2005 Leinsing
6,878,131 B2 4/2005 Novacek et al.
6,884,253 B1 4/2005 McFarlane
6,890,328 B2 5/2005 Fowles et al.
D506,256 S 6/2005 Miyoshi et al.
6,901,975 B2 6/2005 Aramata et al.
6,945,417 B2 9/2005 Jansen et al.
6,948,522 B2 9/2005 Newbrough et al.
6,949,086 B2 9/2005 Ferguson et al.
6,951,613 B2 10/2005 Reif et al.
6,957,745 B2 10/2005 Thibault et al.
6,960,164 B2 11/2005 O'Heeron
6,972,002 B2 12/2005 Thorne
6,979,318 B1 12/2005 McDonald et al.
RE38,996 E 2/2006 Crawford et al.
6,994,315 B2 2/2006 Ryan et al.
6,997,916 B2 2/2006 Simas, Jr. et al.
6,997,917 B2 2/2006 Niedospial, Jr. et al.
7,024,968 B2 4/2006 Raudabough et al.
7,070,589 B2 7/2006 Lolachi et al.
7,074,216 B2 7/2006 Fowles et al.
7,083,600 B2 8/2006 Meloul
7,086,431 B2 8/2006 D'Antonio et al.
7,097,637 B2 8/2006 Triplett et al.
7,100,890 B2 9/2006 Cote, Sr. et al.
7,140,401 B2 11/2006 Wilcox et al.
7,150,735 B2 12/2006 Hickle
7,192,423 B2 3/2007 Wong
7,195,623 B2 3/2007 Burroughs et al.
7,241,285 B1 7/2007 Dikeman
7,294,122 B2 11/2007 Kubo et al.
7,306,199 B2 12/2007 Leinsing et al.
D561,348 S 2/2008 Zinger et al.
7,326,188 B1 2/2008 Russell et al.
7,326,194 B2 2/2008 Zinger et al.
7,350,764 B2 4/2008 Raybuck
7,354,422 B2 4/2008 Riesenberger et al.
7,354,427 B2 4/2008 Fangrow
7,425,209 B2 9/2008 Fowles et al.
7,435,246 B2 10/2008 Zihlmann
D580,558 S 11/2008 Shigesada et al.
7,452,348 B2 11/2008 Hasegawa
7,470,257 B2 12/2008 Norton et al.
7,470,265 B2 12/2008 Brugger et al.
7,472,932 B2 1/2009 Weber et al.
7,488,297 B2 2/2009 Flaherty
7,491,197 B2 2/2009 Jansen et al.
7,497,848 B2 3/2009 Leinsing et al.
7,523,967 B2 4/2009 Steppe
7,530,546 B2 5/2009 Ryan et al.
D595,420 S 6/2009 Suzuki et al.
D595,421 S 6/2009 Suzuki et al.
7,540,863 B2 6/2009 Haindl
7,540,865 B2 6/2009 Griffin et al.
7,544,191 B2 6/2009 Peluso et al.
D595,862 S 7/2009 Suzuki et al.
D595,863 S 7/2009 Suzuki et al.
7,611,487 B2 11/2009 Woehr et al.

(56) References Cited

U.S. PATENT DOCUMENTS

| | | | |
|---|---|---|---|
| 7,611,502 | B2 | 11/2009 | Daly |
| 7,615,041 | B2 | 11/2009 | Sullivan et al. |
| 7,628,779 | B2 | 12/2009 | Aneas |
| 7,632,261 | B2 | 12/2009 | Zinger et al. |
| D608,900 | S | 1/2010 | Giraud et al. |
| 7,654,995 | B2 | 2/2010 | Warren et al. |
| 7,670,326 | B2 | 3/2010 | Shemesh |
| 7,695,445 | B2 | 4/2010 | Yuki |
| 7,704,229 | B2 | 4/2010 | Moberg et al. |
| D616,090 | S | 5/2010 | Kawamura |
| 7,713,247 | B2 | 5/2010 | Lopez |
| 7,717,886 | B2 | 5/2010 | Lopez |
| 7,722,090 | B2 | 5/2010 | Burton et al. |
| D616,984 | S | 6/2010 | Gilboa |
| 7,731,678 | B2 | 6/2010 | Tennican et al. |
| 7,743,799 | B2 | 6/2010 | Mosler et al. |
| 7,744,581 | B2 | 6/2010 | Wallen et al. |
| 7,757,901 | B2 | 7/2010 | Welp |
| 7,758,082 | B2 | 7/2010 | Weigel et al. |
| 7,758,560 | B2 | 7/2010 | Connell et al. |
| 7,762,524 | B2 | 7/2010 | Cawthon et al. |
| 7,766,304 | B2 | 8/2010 | Phillips |
| 7,771,383 | B2 | 8/2010 | Truitt et al. |
| D624,641 | S | 9/2010 | Boclet |
| 7,799,009 | B2 | 9/2010 | Niedospial, Jr. et al. |
| 7,803,140 | B2 | 9/2010 | Fangrow, Jr. |
| D627,216 | S | 11/2010 | Fulginiti |
| D630,732 | S | 1/2011 | Lev et al. |
| 7,862,537 | B2 | 1/2011 | Zinger et al. |
| 7,867,215 | B2 | 1/2011 | Akerlund et al. |
| 7,879,018 | B2 | 2/2011 | Zinger et al. |
| 7,895,216 | B2 | 2/2011 | Longshaw et al. |
| D634,007 | S | 3/2011 | Zinger et al. |
| 7,900,659 | B2 | 3/2011 | Whitley et al. |
| D637,713 | S | 5/2011 | Nord et al. |
| D641,080 | S | 7/2011 | Zinger et al. |
| 7,985,216 | B2 | 7/2011 | Daily et al. |
| D644,104 | S | 8/2011 | Maeda et al. |
| 7,993,328 | B2 | 8/2011 | Whitley |
| 8,007,461 | B2 | 8/2011 | Huo et al. |
| 8,012,132 | B2 | 9/2011 | Lum et al. |
| 8,016,809 | B2 | 9/2011 | Zinger et al. |
| 8,021,325 | B2 | 9/2011 | Zinger et al. |
| 8,025,653 | B2 | 9/2011 | Capitaine et al. |
| 8,025,683 | B2 | 9/2011 | Morrison |
| 8,029,472 | B2 | 10/2011 | Leinsing et al. |
| 8,038,123 | B2 | 10/2011 | Ruschke et al. |
| 8,066,688 | B2 | 11/2011 | Zinger et al. |
| 8,070,739 | B2 | 12/2011 | Zinger et al. |
| 8,075,550 | B2 | 12/2011 | Nord et al. |
| 8,096,525 | B2 | 1/2012 | Ryan |
| 8,105,314 | B2 | 1/2012 | Fangrow, Jr. |
| D654,166 | S | 2/2012 | Lair |
| D655,017 | S | 2/2012 | Mosler et al. |
| 8,122,923 | B2 | 2/2012 | Kraus et al. |
| 8,123,736 | B2 | 2/2012 | Kraushaar et al. |
| D655,071 | S | 3/2012 | Davila |
| D657,461 | S | 4/2012 | Schembre et al. |
| 8,152,779 | B2 | 4/2012 | Cabiri |
| 8,157,784 | B2 | 4/2012 | Rogers |
| 8,167,863 | B2 | 5/2012 | Yow |
| 8,172,824 | B2 | 5/2012 | Pfeifer et al. |
| 8,177,768 | B2 | 5/2012 | Leinsing |
| 8,182,452 | B2 | 5/2012 | Mansour et al. |
| 8,187,248 | B2 | 5/2012 | Zihlmann |
| 8,196,614 | B2 | 6/2012 | Kriheli |
| 8,197,459 | B2 | 6/2012 | Jansen et al. |
| 8,211,069 | B2 | 7/2012 | Fangrow, Jr. |
| 8,225,959 | B2 | 7/2012 | Lambrecht |
| 8,241,268 | B2 | 8/2012 | Whitley |
| 8,262,628 | B2 | 9/2012 | Fangrow, Jr. |
| 8,262,641 | B2 | 9/2012 | Vedrine et al. |
| 8,267,127 | B2 | 9/2012 | Kriheli |
| D669,980 | S | 10/2012 | Lev et al. |
| 8,287,513 | B2 | 10/2012 | Ellstrom et al. |
| 8,328,784 | B2 | 12/2012 | Jensen et al. |
| D673,673 | S | 1/2013 | Wang |
| D674,084 | S | 1/2013 | Linnenschmidt |
| D674,088 | S | 1/2013 | Lev et al. |
| 8,348,898 | B2 | 1/2013 | Cabiri |
| D681,230 | S | 4/2013 | Mosler et al. |
| 8,454,573 | B2 | 6/2013 | Wyatt et al. |
| 8,469,939 | B2 | 6/2013 | Fangrow, Jr. |
| 8,475,404 | B2 | 7/2013 | Foshee et al. |
| 8,480,645 | B1 | 7/2013 | Choudhury et al. |
| 8,480,646 | B2 | 7/2013 | Nord et al. |
| 8,506,548 | B2 | 8/2013 | Okiyama |
| 8,511,352 | B2 | 8/2013 | Kraus et al. |
| 8,512,309 | B2 | 8/2013 | Shemesh et al. |
| D690,009 | S | 9/2013 | Schembre et al. |
| D690,418 | S | 9/2013 | Rosenquist |
| 8,523,837 | B2 | 9/2013 | Wiggins et al. |
| 8,545,476 | B2 | 10/2013 | Ariagno et al. |
| 8,551,067 | B2 | 10/2013 | Zinger et al. |
| 8,556,879 | B2 | 10/2013 | Okiyama |
| 8,562,582 | B2 | 10/2013 | Tuckwell et al. |
| 8,608,723 | B2 | 12/2013 | Lev et al. |
| 8,628,508 | B2 | 1/2014 | Weitzel et al. |
| 8,684,992 | B2 | 4/2014 | Sullivan et al. |
| 8,684,994 | B2 | 4/2014 | Lev et al. |
| 8,752,598 | B2 | 6/2014 | Denenburg et al. |
| D714,935 | S | 10/2014 | Nishioka et al. |
| D717,406 | S | 11/2014 | Stanley et al. |
| D717,948 | S | 11/2014 | Strong et al. |
| D719,650 | S | 12/2014 | Arinobe et al. |
| D720,067 | S | 12/2014 | Rosenquist |
| D720,451 | S | 12/2014 | Denenburg et al. |
| D720,452 | S | 12/2014 | Jordan |
| 8,900,212 | B2 | 12/2014 | Kubo |
| 8,905,994 | B1 | 12/2014 | Lev et al. |
| 8,915,882 | B2 | 12/2014 | Cabiri |
| D720,850 | S | 1/2015 | Hsia et al. |
| D732,660 | S | 6/2015 | Ohashi |
| D732,664 | S | 6/2015 | Woehr et al. |
| D733,291 | S | 6/2015 | Wang |
| D733,292 | S | 6/2015 | Rogers |
| D733,293 | S | 6/2015 | Rogers |
| 9,072,827 | B2 | 7/2015 | Cabiri |
| D738,494 | S | 9/2015 | Kashmirian |
| D741,457 | S | 10/2015 | Guest |
| 9,149,575 | B2 | 10/2015 | Cabiri |
| D750,235 | S | 2/2016 | Maurice |
| D757,933 | S | 5/2016 | Lev et al. |
| 9,393,365 | B2 | 7/2016 | Cabiri |
| 9,486,391 | B2 | 11/2016 | Shemesh |
| 9,492,610 | B2 | 11/2016 | Cabiri |
| 9,511,190 | B2 | 12/2016 | Cabiri |
| 9,522,234 | B2 | 12/2016 | Cabiri |
| D794,183 | S | 8/2017 | Lev et al. |
| 9,763,855 | B2 | 9/2017 | Fangrow |
| 2001/0000347 | A1 | 4/2001 | Hellstrom et al. |
| 2001/0025671 | A1 | 10/2001 | Safabash |
| 2001/0029360 | A1 | 10/2001 | Miyoshi et al. |
| 2001/0051793 | A1 | 12/2001 | Weston |
| 2002/0017328 | A1 | 2/2002 | Loo |
| 2002/0055711 | A1 | 5/2002 | Lavi et al. |
| 2002/0065488 | A1 | 5/2002 | Suzuki et al. |
| 2002/0066715 | A1 | 6/2002 | Niedospial |
| 2002/0087118 | A1 | 7/2002 | Reynolds et al. |
| 2002/0087141 | A1 | 7/2002 | Zinger et al. |
| 2002/0087144 | A1 | 7/2002 | Zinger et al. |
| 2002/0121496 | A1 | 9/2002 | Thiebault et al. |
| 2002/0123736 | A1 | 9/2002 | Fowles et al. |
| 2002/0127150 | A1 | 9/2002 | Sasso |
| 2002/0128628 | A1 | 9/2002 | Fathallah |
| 2002/0138045 | A1 | 9/2002 | Moen |
| 2002/0173752 | A1 | 11/2002 | Polzin |
| 2002/0193777 | A1 | 12/2002 | Aneas |
| 2003/0028156 | A1 | 2/2003 | Juliar |
| 2003/0036725 | A1 | 2/2003 | Lavi et al. |
| 2003/0068354 | A1 | 4/2003 | Reif et al. |
| 2003/0069550 | A1 | 4/2003 | Sharp |
| 2003/0073971 | A1 | 4/2003 | Saker |
| 2003/0100866 | A1 | 5/2003 | Reynolds |

(56) References Cited

U.S. PATENT DOCUMENTS

| | | | |
|---|---|---|---|
| 2003/0109846 | A1 | 6/2003 | Zinger et al. |
| 2003/0120209 | A1 | 6/2003 | Jensen et al. |
| 2003/0135159 | A1 | 7/2003 | Daily et al. |
| 2003/0153895 | A1 | 8/2003 | Leinsing |
| 2003/0187420 | A1 | 10/2003 | Akerlund et al. |
| 2003/0191445 | A1 | 10/2003 | Wallen et al. |
| 2003/0195479 | A1 | 10/2003 | Kuracina et al. |
| 2003/0199827 | A1 | 10/2003 | Thorne |
| 2003/0199846 | A1 | 10/2003 | Fowles et al. |
| 2003/0199847 | A1 | 10/2003 | Akerlund et al. |
| 2003/0205843 | A1 | 11/2003 | Adams |
| 2003/0236543 | A1 | 12/2003 | Brenneman et al. |
| 2004/0010207 | A1 | 1/2004 | Flaherty et al. |
| 2004/0024354 | A1 | 2/2004 | Reynolds |
| 2004/0039365 | A1 | 2/2004 | Aramata et al. |
| 2004/0044327 | A1 | 3/2004 | Hasegawa |
| 2004/0073189 | A1 | 4/2004 | Wyatt et al. |
| 2004/0143218 | A1 | 7/2004 | Das |
| 2004/0143226 | A1 | 7/2004 | Marsden |
| 2004/0153047 | A1 | 8/2004 | Blank et al. |
| 2004/0158172 | A1 | 8/2004 | Hancock |
| 2004/0162540 | A1 | 8/2004 | Walenciak et al. |
| 2004/0167472 | A1 | 8/2004 | Howell et al. |
| 2004/0181192 | A1 | 9/2004 | Cuppy |
| 2004/0186424 | A1 | 9/2004 | Hjertman |
| 2004/0199139 | A1 | 10/2004 | Fowles et al. |
| 2004/0204699 | A1 | 10/2004 | Hanly et al. |
| 2004/0217315 | A1 | 11/2004 | Doyle |
| 2004/0225274 | A1 | 11/2004 | Jansen et al. |
| 2004/0236305 | A1 | 11/2004 | Jansen et al. |
| 2004/0249341 | A1 | 12/2004 | Newbrough et al. |
| 2004/0255952 | A1 | 12/2004 | Carlsen et al. |
| 2005/0015070 | A1 | 1/2005 | Delnevo et al. |
| 2005/0016626 | A1 | 1/2005 | Wilcox et al. |
| 2005/0049553 | A1 | 3/2005 | Triplett et al. |
| 2005/0055008 | A1 | 3/2005 | Paradis et al. |
| 2005/0082828 | A1 | 4/2005 | Wicks et al. |
| 2005/0124964 | A1 | 6/2005 | Niedospial et al. |
| 2005/0137523 | A1 | 6/2005 | Wyatt et al. |
| 2005/0137566 | A1 | 6/2005 | Fowles et al. |
| 2005/0148994 | A1 | 7/2005 | Leinsing |
| 2005/0159706 | A1 | 7/2005 | Wilkinson et al. |
| 2005/0159724 | A1 | 7/2005 | Enerson |
| 2005/0182383 | A1 | 8/2005 | Wallen |
| 2005/0209554 | A1 | 9/2005 | Landau |
| 2005/0261637 | A1 | 11/2005 | Miller |
| 2005/0277896 | A1 | 12/2005 | Messerli et al. |
| 2006/0030832 | A1 | 2/2006 | Niedospial et al. |
| 2006/0079834 | A1 | 4/2006 | Tennican et al. |
| 2006/0089594 | A1 | 4/2006 | Landau |
| 2006/0089603 | A1 | 4/2006 | Truitt et al. |
| 2006/0095015 | A1 | 5/2006 | Hobbs et al. |
| 2006/0106360 | A1 | 5/2006 | Wong |
| 2006/0135948 | A1 | 6/2006 | Varma |
| 2006/0155257 | A1 | 7/2006 | Reynolds |
| 2006/0161192 | A1 | 7/2006 | Young |
| 2006/0173410 | A1 | 8/2006 | Moberg et al. |
| 2006/0178646 | A1 | 8/2006 | Harris et al. |
| 2006/0195029 | A1 | 8/2006 | Shults et al. |
| 2006/0212004 | A1 | 9/2006 | Atil |
| 2006/0253084 | A1 | 11/2006 | Nordgren |
| 2006/0259004 | A1 | 11/2006 | Connell et al. |
| 2007/0016381 | A1 | 1/2007 | Kamath et al. |
| 2007/0024995 | A1 | 2/2007 | Hayashi |
| 2007/0060904 | A1 | 3/2007 | Vedrine et al. |
| 2007/0078428 | A1 | 4/2007 | Reynolds et al. |
| 2007/0079894 | A1 | 4/2007 | Kraus et al. |
| 2007/0083164 | A1 | 4/2007 | Barrelle et al. |
| 2007/0088252 | A1 | 4/2007 | Pestotnik et al. |
| 2007/0088293 | A1 | 4/2007 | Fangrow |
| 2007/0088313 | A1 | 4/2007 | Zinger et al. |
| 2007/0106218 | A1 | 5/2007 | Yodfat et al. |
| 2007/0106244 | A1 | 5/2007 | Mosler et al. |
| 2007/0112324 | A1 | 5/2007 | Hamedi-Sangsari |
| 2007/0156112 | A1 | 7/2007 | Walsh |
| 2007/0167904 | A1 | 7/2007 | Zinger et al. |
| 2007/0167912 | A1 | 7/2007 | Causey et al. |
| 2007/0191760 | A1 | 8/2007 | Iguchi et al. |
| 2007/0191764 | A1 | 8/2007 | Zihlmann |
| 2007/0191767 | A1 | 8/2007 | Hennessy et al. |
| 2007/0203451 | A1 | 8/2007 | Murakami et al. |
| 2007/0219483 | A1 | 9/2007 | Kitani et al. |
| 2007/0244447 | A1 | 10/2007 | Capitaine et al. |
| 2007/0244461 | A1 | 10/2007 | Fangrow |
| 2007/0244462 | A1 | 10/2007 | Fangrow |
| 2007/0244463 | A1 | 10/2007 | Warren et al. |
| 2007/0249995 | A1 | 10/2007 | Van Manen |
| 2007/0255202 | A1 | 11/2007 | Kitani et al. |
| 2007/0265574 | A1 | 11/2007 | Tennican et al. |
| 2007/0265581 | A1 | 11/2007 | Funamura et al. |
| 2007/0270778 | A9 | 11/2007 | Zinger et al. |
| 2007/0287953 | A1 | 12/2007 | Ziv et al. |
| 2007/0299404 | A1 | 12/2007 | Katoh et al. |
| 2008/0009789 | A1 | 1/2008 | Zinger et al. |
| 2008/0009822 | A1 | 1/2008 | Enerson |
| 2008/0015496 | A1 | 1/2008 | Hamedi-Sangsari |
| 2008/0135051 | A1 | 6/2008 | Lee |
| 2008/0172024 | A1 | 7/2008 | Yow |
| 2008/0188799 | A1 | 8/2008 | Mueller-Beckhaus et al. |
| 2008/0195049 | A1 | 8/2008 | Thalmann et al. |
| 2008/0208138 | A1 | 8/2008 | Lim et al. |
| 2008/0215015 | A1 | 9/2008 | Cindrich et al. |
| 2008/0249473 | A1 | 10/2008 | Rutti et al. |
| 2008/0249479 | A1 | 10/2008 | Zinger et al. |
| 2008/0249498 | A1 | 10/2008 | Fangrow |
| 2008/0262465 | A1 | 10/2008 | Zinger et al. |
| 2008/0269687 | A1 | 10/2008 | Chong et al. |
| 2008/0275407 | A1 | 11/2008 | Scheurer |
| 2008/0287905 | A1 | 11/2008 | Hiejima et al. |
| 2008/0294100 | A1 | 11/2008 | de Costa et al. |
| 2008/0306439 | A1 | 12/2008 | Nelson et al. |
| 2008/0312634 | A1 | 12/2008 | Helmerson |
| 2009/0012492 | A1 | 1/2009 | Zihlmann |
| 2009/0043253 | A1 | 2/2009 | Podaima |
| 2009/0054834 | A1 | 2/2009 | Zinger et al. |
| 2009/0054852 | A1 | 2/2009 | Takano et al. |
| 2009/0062767 | A1 | 3/2009 | Van Antwerp et al. |
| 2009/0076360 | A1 | 3/2009 | Brister et al. |
| 2009/0082750 | A1 | 3/2009 | Denenburg et al. |
| 2009/0139724 | A1 | 6/2009 | Gray et al. |
| 2009/0143758 | A1 | 6/2009 | Okiyama |
| 2009/0177177 | A1 | 7/2009 | Zinger |
| 2009/0177178 | A1 | 7/2009 | Pedersen |
| 2009/0187140 | A1 | 7/2009 | Racz |
| 2009/0216103 | A1 | 8/2009 | Brister et al. |
| 2009/0216212 | A1 | 8/2009 | Fangrow, Jr. |
| 2009/0267011 | A1 | 10/2009 | Hatton et al. |
| 2009/0299325 | A1 | 12/2009 | Vedrine et al. |
| 2009/0318946 | A1 | 12/2009 | Tamesada |
| 2009/0326506 | A1 | 12/2009 | Hasegawa et al. |
| 2010/0010443 | A1 | 1/2010 | Morgan et al. |
| 2010/0016811 | A1 | 1/2010 | Smith |
| 2010/0022985 | A1 | 1/2010 | Sullivan et al. |
| 2010/0030181 | A1 | 2/2010 | Helle et al. |
| 2010/0036319 | A1 | 2/2010 | Drake et al. |
| 2010/0076397 | A1 | 3/2010 | Reed et al. |
| 2010/0087786 | A1 | 4/2010 | Zinger et al. |
| 2010/0137827 | A1 | 6/2010 | Warren et al. |
| 2010/0137831 | A1 | 6/2010 | Tsals |
| 2010/0152658 | A1 | 6/2010 | Hanson et al. |
| 2010/0160889 | A1 | 6/2010 | Smith et al. |
| 2010/0162548 | A1 | 7/2010 | Leidig |
| 2010/0168664 | A1 | 7/2010 | Zinger et al. |
| 2010/0168712 | A1 | 7/2010 | Tuckwell et al. |
| 2010/0179506 | A1 | 7/2010 | Shemesh et al. |
| 2010/0198148 | A1 | 8/2010 | Zinger et al. |
| 2010/0204670 | A1 | 8/2010 | Kraushaar et al. |
| 2010/0228220 | A1 | 9/2010 | Zinger et al. |
| 2010/0241088 | A1 | 9/2010 | Ranalletta et al. |
| 2010/0274184 | A1 | 10/2010 | Chun |
| 2010/0274202 | A1 | 10/2010 | Hyde et al. |
| 2010/0286661 | A1 | 11/2010 | Raday et al. |
| 2010/0312220 | A1 | 12/2010 | Kalitzki |
| 2011/0004143 | A1 | 1/2011 | Beiriger et al. |

(56) References Cited

U.S. PATENT DOCUMENTS

| | | | |
|---|---|---|---|
| 2011/0004184 | A1 | 1/2011 | Proksch et al. |
| 2011/0044850 | A1 | 2/2011 | Solomon et al. |
| 2011/0054440 | A1 | 3/2011 | Lewis |
| 2011/0087164 | A1 | 4/2011 | Mosler et al. |
| 2011/0125056 | A1 | 5/2011 | Merchant |
| 2011/0144584 | A1 | 6/2011 | Wozencroft |
| 2011/0160655 | A1 | 6/2011 | Hanson et al. |
| 2011/0160701 | A1 | 6/2011 | Wyatt et al. |
| 2011/0172636 | A1 | 7/2011 | Aasmul |
| 2011/0175347 | A1 | 7/2011 | Okiyama |
| 2011/0218511 | A1 | 9/2011 | Yokoyama |
| 2011/0224640 | A1 | 9/2011 | Kuhn et al. |
| 2011/0230856 | A1 | 9/2011 | Kyle et al. |
| 2011/0264037 | A1 | 10/2011 | Foshee et al. |
| 2011/0264069 | A1 | 10/2011 | Bochenko |
| 2011/0276007 | A1 | 11/2011 | Denenburg |
| 2011/0319827 | A1 | 12/2011 | Leinsing et al. |
| 2012/0022344 | A1 | 1/2012 | Kube |
| 2012/0022469 | A1 | 1/2012 | Alpert |
| 2012/0053555 | A1 | 3/2012 | Ariagno et al. |
| 2012/0059332 | A1 | 3/2012 | Woehr et al. |
| 2012/0059346 | A1 | 3/2012 | Sheppard et al. |
| 2012/0067429 | A1 | 3/2012 | Mosler et al. |
| 2012/0071819 | A1 | 3/2012 | Bruggemann et al. |
| 2012/0078214 | A1 | 3/2012 | Finke et al. |
| 2012/0123382 | A1 | 5/2012 | Kubo |
| 2012/0184938 | A1 | 7/2012 | Lev et al. |
| 2012/0215182 | A1 | 8/2012 | Mansour et al. |
| 2012/0220977 | A1 | 8/2012 | Yow |
| 2012/0220978 | A1 | 8/2012 | Lev et al. |
| 2012/0265163 | A1 | 10/2012 | Cheng et al. |
| 2012/0271229 | A1 | 10/2012 | Lev et al. |
| 2012/0296307 | A1 | 11/2012 | Holt et al. |
| 2012/0310203 | A1 | 12/2012 | Khaled et al. |
| 2012/0323172 | A1 | 12/2012 | Lev et al. |
| 2012/0323187 | A1 | 12/2012 | Iwase et al. |
| 2012/0323210 | A1 | 12/2012 | Lev et al. |
| 2013/0046269 | A1 | 2/2013 | Lev et al. |
| 2013/0053814 | A1 | 2/2013 | Mueller-Beckhaus et al. |
| 2013/0096493 | A1 | 4/2013 | Kubo et al. |
| 2013/0110049 | A1 | 5/2013 | Cronenberg et al. |
| 2013/0144248 | A1 | 6/2013 | Putter et al. |
| 2013/0199669 | A1 | 8/2013 | Moy et al. |
| 2013/0226100 | A1 | 8/2013 | Lev |
| 2013/0231630 | A1 | 9/2013 | Kraus et al. |
| 2013/0237904 | A1 | 9/2013 | Deneburg et al. |
| 2013/0253448 | A1 | 9/2013 | Baron et al. |
| 2013/0289530 | A1 | 10/2013 | Wyatt et al. |
| 2014/0020793 | A1 | 1/2014 | Denenburg et al. |
| 2014/0096862 | A1 | 4/2014 | Aneas |
| 2014/0150911 | A1 | 6/2014 | Hanner et al. |
| 2014/0194854 | A1 | 7/2014 | Tsals |
| 2014/0221940 | A1 | 8/2014 | Clauson et al. |
| 2014/0277052 | A1 | 9/2014 | Haselby et al. |
| 2014/0352845 | A1 | 12/2014 | Lev et al. |
| 2015/0082746 | A1 | 3/2015 | Ivosevic et al. |
| 2015/0088078 | A1 | 3/2015 | Lev et al. |
| 2015/0290390 | A1 | 10/2015 | Ring et al. |
| 2015/0305770 | A1 | 10/2015 | Fill et al. |
| 2016/0088995 | A1 | 3/2016 | Ueda et al. |
| 2016/0199569 | A1 | 7/2016 | Yevmenenko et al. |
| 2016/0228644 | A1 | 8/2016 | Cabiri |
| 2016/0287475 | A1 | 10/2016 | Yevmenenko et al. |

FOREIGN PATENT DOCUMENTS

| | | | |
|---|---|---|---|
| CN | 1863566 | A | 11/2006 |
| CN | 1950049 | A | 4/2007 |
| CN | 101001661 | A | 7/2007 |
| CN | 101687083 | A | 3/2010 |
| DE | 1064693 | B | 9/1959 |
| DE | 1913926 | A1 | 9/1970 |
| DE | 4122476 | A1 | 1/1993 |
| DE | 19504413 | A1 | 8/1996 |
| DE | 202004012714 | U1 | 11/2004 |
| DE | 202009011019 | U1 | 12/2010 |
| EM | 000627237-0001 | | 1/2007 |
| EM | 001680703-0002 | | 3/2010 |
| EP | 0192661 | A1 | 9/1986 |
| EP | 0195018 | A1 | 9/1986 |
| EP | 0258913 | A2 | 3/1988 |
| EP | 0416454 | A2 | 3/1991 |
| EP | 0282545 | B1 | 2/1992 |
| EP | 0518397 | A1 | 12/1992 |
| EP | 0521460 | A1 | 1/1993 |
| EP | 582038 | A2 | 2/1994 |
| EP | 0598918 | A1 | 6/1994 |
| EP | 0637443 | A1 | 2/1995 |
| EP | 0737467 | A1 | 10/1996 |
| EP | 761562 | A1 | 3/1997 |
| EP | 765652 | A1 | 4/1997 |
| EP | 765853 | A1 | 4/1997 |
| EP | 0806597 | A1 | 11/1997 |
| EP | 0814866 | A1 | 1/1998 |
| EP | 829248 | A2 | 3/1998 |
| EP | 0856331 | A2 | 8/1998 |
| EP | 882441 | A2 | 12/1998 |
| EP | 0887085 | A2 | 12/1998 |
| EP | 0887885 | A2 | 12/1998 |
| EP | 897708 | A2 | 2/1999 |
| EP | 0898951 | A2 | 3/1999 |
| EP | 960616 | A2 | 12/1999 |
| EP | 1008337 | A1 | 6/2000 |
| EP | 1029526 | A1 | 8/2000 |
| EP | 1034809 | A1 | 9/2000 |
| EP | 1051988 | A2 | 11/2000 |
| EP | 1323403 | A1 | 7/2003 |
| EP | 1329210 | A1 | 7/2003 |
| EP | 1396250 | A1 | 3/2004 |
| EP | 1454609 | A1 | 9/2004 |
| EP | 1454650 | A1 | 9/2004 |
| EP | 1498097 | A2 | 1/2005 |
| EP | 1872824 | A1 | 1/2008 |
| EP | 1911432 | A1 | 4/2008 |
| EP | 1919432 | A1 | 5/2008 |
| EP | 1930038 | A2 | 6/2008 |
| EP | 2090278 | A1 | 8/2009 |
| EP | 2351548 | A1 | 8/2011 |
| EP | 2351549 | A1 | 8/2011 |
| EP | 2462913 | A1 | 6/2012 |
| EP | 2512399 | A1 | 10/2012 |
| FR | 2029242 | A5 | 10/1970 |
| FR | 2856660 | A1 | 12/2004 |
| FR | 2869795 | A1 | 11/2005 |
| FR | 2931363 | A1 | 11/2009 |
| GB | 1444210 | A | 7/1976 |
| IL | 171662 | | 10/2005 |
| IL | 186290 | | 1/2008 |
| JP | 03-062426 | B | 9/1991 |
| JP | 4329954 | A | 11/1992 |
| JP | 06-050656 | U | 7/1994 |
| JP | H08-000710 | A | 1/1996 |
| JP | 09-104460 | A | 4/1997 |
| JP | 09-104461 | A | 4/1997 |
| JP | 10-118158 | A | 5/1998 |
| JP | H10-504736 | A | 5/1998 |
| JP | 11503627 | T | 3/1999 |
| JP | 11-319031 | A | 11/1999 |
| JP | 2000-508934 | A | 7/2000 |
| JP | 2000-237278 | A | 9/2000 |
| JP | 2000262497 | A | 9/2000 |
| JP | 2001-505083 | A | 4/2001 |
| JP | 2002-035140 | A | 2/2002 |
| JP | 2002-516160 | A | 6/2002 |
| JP | 2002-355318 | A | 12/2002 |
| JP | 2003-033441 | A | 2/2003 |
| JP | 2003-102807 | A | 4/2003 |
| JP | 2004-501721 | A | 1/2004 |
| JP | 2004-097253 | A | 4/2004 |
| JP | 2004-522541 | A | 7/2004 |
| JP | 2005-270629 | A | 10/2005 |
| JP | 200661421 | A | 3/2006 |
| JP | 2008-220961 | A | 9/2008 |
| JP | 2010-179128 | A | 8/2010 |

(56) References Cited

FOREIGN PATENT DOCUMENTS

| | | | |
|---|---|---|---|
| JP | 2012-205769 | A | 10/2012 |
| JP | 2014000220 | A | 1/2014 |
| WO | 8601712 | A1 | 3/1986 |
| WO | 8605683 | A1 | 10/1986 |
| WO | 9003536 | A1 | 4/1990 |
| WO | 9403373 | A1 | 2/1994 |
| WO | 9507066 | A1 | 3/1995 |
| WO | 9600053 | A1 | 1/1996 |
| WO | 9609083 | A1 | 3/1996 |
| WO | 9629113 | A1 | 9/1996 |
| WO | 9736636 | A1 | 10/1997 |
| WO | 9832411 | A1 | 7/1998 |
| WO | 9837854 | A1 | 9/1998 |
| WO | 9961093 | A1 | 12/1999 |
| WO | 0128490 | A1 | 4/2001 |
| WO | 0130425 | A1 | 5/2001 |
| WO | 0132542 | A1 | 5/2001 |
| WO | 0160311 | A1 | 8/2001 |
| WO | 0189607 | A2 | 11/2001 |
| WO | 0191693 | A2 | 12/2001 |
| WO | 0202165 | A2 | 1/2002 |
| WO | 200209797 | A1 | 2/2002 |
| WO | 0232372 | A1 | 4/2002 |
| WO | 0236191 | A2 | 5/2002 |
| WO | 02066100 | A2 | 8/2002 |
| WO | 02089900 | A1 | 11/2002 |
| WO | 03051423 | A2 | 6/2003 |
| WO | 03070147 | A2 | 8/2003 |
| WO | 03079956 | A1 | 10/2003 |
| WO | 2004041148 | A1 | 5/2004 |
| WO | 2005002492 | A1 | 1/2005 |
| WO | 2005018703 | A2 | 3/2005 |
| WO | 2005041846 | A2 | 5/2005 |
| WO | 2005105014 | A2 | 11/2005 |
| WO | 2006099441 | A2 | 9/2006 |
| WO | 2007015233 | A1 | 2/2007 |
| WO | 2007017868 | A1 | 2/2007 |
| WO | 2007052252 | A1 | 5/2007 |
| WO | 2007101772 | A1 | 9/2007 |
| WO | 2007105221 | A1 | 9/2007 |
| WO | 2008076459 | A1 | 6/2008 |
| WO | 2008081424 | A2 | 7/2008 |
| WO | 2008126090 | A1 | 10/2008 |
| WO | 2009026443 | A2 | 2/2009 |
| WO | 2009029010 | A1 | 3/2009 |
| WO | 2009038860 | A2 | 3/2009 |
| WO | 2009040804 | A2 | 4/2009 |
| WO | 2009087572 | A1 | 7/2009 |
| WO | 2009093249 | A1 | 7/2009 |
| WO | 2009112489 | A1 | 9/2009 |
| WO | 2009146088 | A1 | 12/2009 |
| WO | 2010061743 | A1 | 6/2010 |
| WO | 2010078227 | A1 | 7/2010 |
| WO | 2010117580 | A1 | 10/2010 |
| WO | 2011004360 | A1 | 1/2011 |
| WO | 2011039747 | A1 | 4/2011 |
| WO | 2011058545 | A1 | 5/2011 |
| WO | 2011058548 | A1 | 5/2011 |
| WO | 2011077434 | A1 | 6/2011 |
| WO | 2011090955 | A1 | 7/2011 |
| WO | 2011104711 | A1 | 9/2011 |
| WO | 2011156373 | A1 | 12/2011 |
| WO | 2012004784 | A1 | 1/2012 |
| WO | 2012063230 | A1 | 5/2012 |
| WO | 2012143921 | A1 | 10/2012 |
| WO | 2012150587 | A1 | 11/2012 |
| WO | 2013127813 | A1 | 9/2013 |
| WO | 2013134246 | A1 | 9/2013 |
| WO | 2013148435 | A1 | 10/2013 |
| WO | 2013156944 | A1 | 10/2013 |
| WO | 2013156994 | A1 | 10/2013 |
| WO | 2014033706 | A2 | 3/2014 |
| WO | 2014033710 | A1 | 3/2014 |
| WO | 2014174278 | A1 | 10/2014 |
| WO | 2016023590 | A1 | 2/2016 |

OTHER PUBLICATIONS

Novel Transfer, Mixing and Drug Delivery Systems, MOP Medimop Medical Projects Ltd. Catalog, 4 pages, Rev. 4, 2004.
Smart Site.RTM. Alaris Medical Systems Product Brochure, 4 pages, Issue 1, Oct. 1999.
MixJect, downloaded from webpage: http://www.westpharma.com/en/products/Pages/Mixject.aspx, Download Date: Aug. 8, 2012, 1 page.
MixJet Product Information Sheet, downloaded from webpage: http://www.westpharma.com/SiteCollectionDocuments/Recon/mixject%20product%20sheet.pdf; 1 page.
The MixJect transfer system, as shown in the article, "Advanced Delivery Devices," Drug Delivery Technology Jul./Aug. 2007 vol. 7 No. 7 [on-line]. [Retrieved from Internet May 14, 2010] URL: <http://www.drugdeiverytech-online.com/drugdelivery/200707/?pg=28pg28>. (3 pages).
Publication date of Israeli Patent Application 186290 [on-line]. Retrieved from Internet May 24, 2010. URL:<http://www.ilpatsearch.justrice.gov.il/UI/RequestsList.aspx>. (1 page).
Silicone Rubber Overview Downloaded from webpage: http://www.knovel.com/web/portal/browse/display?_EXT_KNOVEL_DISPLAY_bookid=1023&VerticalID=0 on Sep. 2, 2011, Download Date: Sep. 2, 2011, Original Posting Date: 2010, 6 pages.
U.S. Appl. No. 13/498,378 by Lev, filed Mar. 27, 2012.
Kipp, "Plastic Material Data Sheets," retrieved from the internet: http://www.knovel.com/web/portal/browse/display?_EXT_KNOVEL_DISPLAY_bookid=1023&VerticalID=0, retrieved on Feb. 9, 2011.
U.S. Appl. No. 13/505,790 by Lev, filed May 3, 2012.
U.S. Appl. No. 13/505,881 by Lev, filed May 3, 2012.
U.S. Appl. No. 13/522,410 by Lev, filed Jul. 16, 2012.
U.S. Appl. No. 13/576,461 by Lev, filed Aug. 1, 2012.
Alaris Medical Systems Product Brochure, 4 pages, Issue 1, Oct. 11, 1999.
Smart Site Needle-Free Systems, Alaris Medical Systems Webpage, 4 pages, Feb. 2006.
Photographs of Alaris Medical Systems SmartSite.RTM. device, 5 pages, 2002.
Non-Vented Vial Access Pin with ULTRASITE.RTM. Valve, B. Braun Medical, Inc. website and product description, 3 pages, Feb. 2006.
U.S. Appl. No. 29/438,134 by Lev, filed Nov. 27, 2012.
U.S. Appl. No. 29/438,141 by Gilboa, filed Nov. 27, 2012.
U.S. Appl. No. 13/883,289 by Lev, filed May 3, 2013.
U.S. Appl. No. 13/884,981 by Denenburg, filed May 13, 2013.
U.S. Appl. No. 14/005,751 by Denenburg, filed Sep. 17, 2013.
IV disposables sets catalogue, Cardinal Health, Alaris® products, SmartSite® access devices and accessories product No. 10013365, SmartSite add-on bag access device with spike adapter and needle-free valve bag access port, pp. 1-5, Fall edition (2007).
Drug Administration Systems product information sheets; http://www.westpharma.cornieu/en/products/Pages/Vial2Bag.aspx; pp. 1-3 (admitted prior art).
Article with picture of West Pharmaceutical Services' Vial2Bag Needleless System, [on-line]; ISIPS Newsletter, Oct. 26, 2007; retrieved from Internet Feb. 16, 2010; URL:<http://www.isips.org/reports/ISIPS_Newsletter_October_26_2007. html.> (7 pages. see pp. 5-6).
U.S. Appl. No. 29/478,723 by Lev, filed Jan. 8, 2014.
U.S. Appl. No. 29/478,726 by Lev, filed Jan. 8, 2014.
U.S. Appl. No. 14/345,094 by Lev, filed Mar. 14, 2014.
U.S. Appl. No. 14/366,306 by Lev, filed Jun. 18, 2014.
Written Opinion dated Jul. 1, 2013 in Int'l Application No. PCT/IL2013/050180.
Written Opinion dated Jul. 31, 2013 in Int'l Application No. PCT/IL2013/050313.
U.S. Appl. No. 14/385,212 by Lev, filed Sep. 15, 2014.
U.S. Appl. No. 29/502,037 by Lev, filed Sep. 11, 2014.
U.S. Appl. No. 29/502,053 by Lev, filed Sep. 11, 2014
U.S. Appl. No. 14/391,792 by Lev, filed Oct. 10, 2014.
U.S. Appl. No. 14/504,979, by Lev, filed Oct. 2, 2014.
U.S. Appl. No. 14/423,595 by Lev, filed Feb. 24, 2015.
U.S. Appl. No. 14/423,612 by Lev, filed Feb. 24, 2015.

(56) References Cited

OTHER PUBLICATIONS

U.S. Appl. No. 14/425,582 by Lev, filed Mar. 3, 2015.
U.S. Appl. No. 14/888,590 by Marks, filed Nov. 2, 2015.
U.S. Appl. No. 14/784,300, by Lev, filed Oct. 14, 2015.
U.S. Appl. No. 29/544,969 by Ben Shalom, filed Nov. 9, 2015.
West, Vial2Bag DC system, Oct. 2, 2014, https://web.archive.org/web/20141002065133/http://www.westpharma.com/en/products/Pages/Reconstitutionsystems.aspx.
Vial2Bag DC, downloaded from webpage: https://www.youtube.com/watch?v=FEOkglxNBrs, Original posting date: Aug. 21, 2014, 1 page.
Vial-Mate Adapter Device, Baxter, May 2017, downloaded from web page:http://www.baxtermedicationdeliveryproducts.com/drug-deliver/vialmate.html, Download Date: Jul. 28, 2017, original posting date: unknown, 1page.
Int'l Preliminary Report on Patentability dated Feb. 13, 2018 in Int'l Application No. PCT/IL2016/051265.

* cited by examiner

DUAL VIAL ADAPTER ASSEMBLAGE INCLUDING DRUG VIAL ADAPTER WITH SELF-SEALING ACCESS VALVE

CROSS-REFERENCE TO RELATED APPLICATION

This application is a Section 371 of International Application No. PCT/IL2016/051265, filed Nov. 24, 2016, which was published in the English language on Jun. 1, 2017 under International Publication No. WO 2017/090042 A1, and claims priority under 35 U.S.C. § 119(b) to Israeli Application No. 242776, filed Nov. 25, 2015 and Israeli Application No. 245641 filed May 15, 2016, the disclosures of which are incorporated herein by reference in their entirety.

FIELD OF THE INVENTION

The invention relates to dual vial adapter assemblages for use with a needleless syringe, a drug vial containing a medicament, and a liquid vial containing liquid contents.

BACKGROUND OF THE INVENTION

Commonly owned U.S. Pat. No. 6,558,365 to Zinger et al. entitled Fluid Transfer Device discloses a dual vial adapter assemblage for use with a needleless syringe, a drug vial containing a medicament, and a liquid vial containing liquid contents. The drug vial is under negative pressure. The needleless syringe is preferably formed with a male Luer lock connector. The medicament can be in the form of a powder, solid or liquid. The liquid contents can be in the form of diluent only or alternatively include an active component. Dual vial adapter assemblages constructed and operative in accordance with U.S. Pat. No. 6,558,365 are commercially available from West Pharmaceutical Services, Inc., Exton, USA under the registered trademark MIX2VIAL.

U.S. Pat. No. 6,558,365 dual vial adapter assemblages include a drug vial adapter for telescopic mounting on a drug vial and a liquid vial adapter for telescopic mounting on a liquid vial and in initial releasable engagement with the drug vial adapter. The liquid vial adapter includes a male connector in flow communication with a liquid vial stopper puncturing cannula for puncturing a liquid vial stopper on telescopic mounting the liquid vial adapter on a liquid vial. The male connector is preferably a male Luer lock connector. The drug vial adapter includes a female connector in flow communication with a drug vial stopper puncturing cannula for puncturing a drug vial stopper on telescopic mounting the drug vial adapter on a drug vial. The female connector is preferably a female Luer connector with a screw thread for screw thread attachment of a male Luer lock connector thereon.

The use of U.S. Pat. No. 6,558,365 dual vial adapter assemblage is as follows: The dual vial adapter assemblage is provided in an initial flow communication position with the liquid vial adapter screw thread mounted on the drug vial adapter such that the liquid vial adapter's male connector is in flow communication with the drug vial adapter's female connector. The liquid vial adapter is telescopic mounted onto the liquid vial placed on a horizontal work table. The dual vial adapter assemblage is inverted ready for telescopic mounting the drug vial adapter on the drug vial placed on the horizontal work table with the liquid vial adapter above the drug vial adapter. On telescopic mounting the drug vial adapter on the drug vial, the negative pressure draws the liquid contents downward from the liquid vial into the drug vial for forming a liquid drug in the drug vial. The liquid vial adapter is unthreaded from the drug vial adapter and the needleless syringe is attached to its female connector ready for aspiration of the liquid drug from the drug vial to the needleless syringe. The entire liquid drug contents can be aspirated from the drug vial either in a single aspiration or two or more aspirations in quick succession. Subsequent aspirations after a prolonged detachment of the liquid vial adapter from the drug vial adapter is generally refrained due to concern of lack of sterility.

There is a need for a dual vial adapter assemblage for facilitating multiple aspirations of liquid drug dosages from a drug vial under sterile conditions after a prolonged detachment of a liquid vial adapter from a drug vial adapter.

SUMMARY OF THE INVENTION

The present invention is directed towards a dual vial adapter assemblage similar to the aforementioned commonly owned U.S. Pat. No. 6,558,365. The present invention differs from the former insofar as the present invention includes a drug vial adapter with a female connector fitted with a normally closed needlefree swabable self-sealing access valve which can be selectively opened to a flow communication state on insertion of a male connector therein and a manually operable flow control arrangement. Such normally closed needlefree swabable self-sealing access valves are commercially available from inter alia Halkey Roberts, and the like. http://www.halkeyroberts.com/products/medical/general.aspx.

The flow control arrangement has the following three operative positions: First, an initial extended set-up position in which the liquid vial adapter engages the drug vial adapter without the liquid vial adapter's male connector being inserted in the drug vial adapter's female connector such that its self-sealing access valve remains closed. Second, an intermediate compacted flow communication position for urging the liquid vial adapter's male connector into the female connector for compressing the self-sealing access valve into a flow communication state for enabling flow communication between the drug vial and the liquid vial for enabling formation of liquid drug contents in the drug vial. And third, a final detachment position for enabling detachment of the liquid vial adapter from the drug vial adapter thereby providing access to the self-sealing access valve for repeated aspirations of liquid drug contents from the drug vial.

The extended set-up position enables the dual vial adapter assemblage to be stored for its intended shelf life without concern regarding the normally closed self-sealing access valve becoming unfit for use due to prolonged storage in its compressed flow communication state which may deteriorate its self-sealing capability. The liquid vial adapter's male connector preferably contacts the self-sealing access valve so as to maintain its sterility during storage in the initial extended set-up position of the dual vial adapter assemblage. Accordingly, the dual vial adapter assemblage is ready to use on removal from its sterile packaging without the need to swab the self-sealing access valve prior to the first aspiration of liquid drug contents. Alternatively, the male connector can be spaced apart from the self-sealing access valve in the initial extended set-up position. Accordingly, the self-sealing access valve is maintained sterile by being covered by a manually removable label to be removed before use of the dual vial adapter assemblage.

The use of the dual vial adapter assemblage of the present invention is modified from the U.S. Pat. No. 6,558,365 dual vial adapter assemblage insofar as a user is required to initially dispose the dual vial adapter assemblage from its initial extended set-up position to its intermediate compacted flow communication position before forming liquid drug contents in a drug vial. The dual vial adapter assemblage of the present invention can be implemented such that the flow control arrangement requires either a manual linear compaction of a liquid vial adapter towards a drug vial adapter or a manual rotational compaction of a liquid vial adapter relative to a drug vial adapter for urging the flow control arrangement from its initial extended set-up position to its intermediate compacted flow communication position. Flow control arrangements can be implemented with different types of mechanical arrangements including hook member arrangements including at least one hook member, bayonet arrangements including at least one pin and groove pair, screw thread arrangements, and the like.

In the case of a flow control arrangement involving a linear compaction of a liquid vial adapter towards a drug vial adapter, a dual vial adapter assemblage can be preferably packaged in a blister for assisting a user to follow a prescribed set of instructions for use. The blister includes an internal rigid restrainer arrangement at its blister container open end for preventing immediate snap fit of a liquid vial adapter on a liquid vial on telescopic mounting of a liquid vial adapter on a liquid vial. The internal rigid restrainer arrangement can be provided as a discrete restrainer ring for mounting inside a blister container open end or alternatively can be an integral design feature. Suitable mountings include inter alia snap fits, gluing, and the like.

BRIEF DESCRIPTION OF DRAWINGS

In order to understand the invention and to see how it can be carried out in practice, preferred embodiments will now be described, by way of non-limiting examples only, with reference to the accompanying drawings in which similar parts are likewise numbered, and in which.

DETAILED DESCRIPTION OF PREFERRED EMBODIMENTS OF THE INVENTION

Figure 1:
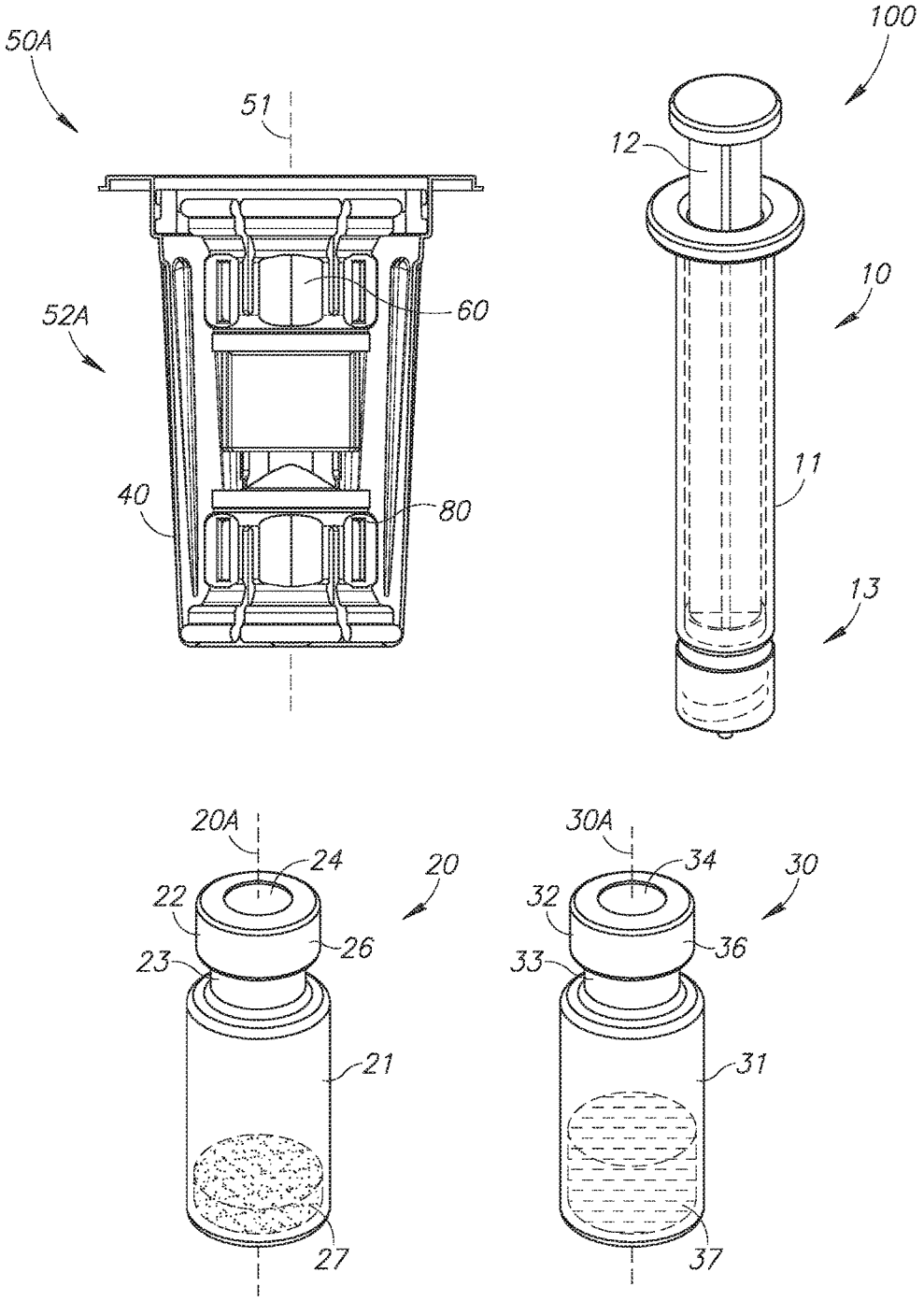
FIG. 1 is a pictorial view of an administration set including a needleless syringe, a drug vial, a liquid vial, and a blister including a dual vial adapter assemblage in its initial extended set-up position in accordance with a first embodiment of the present invention.

FIG. 1 shows an administration set 100 including an initially empty needleless syringe 10, a drug vial 20, a liquid vial 30, and a blister 40 for containing a dual vial adapter assemblage 50A. The needleless syringe 10 includes a barrel 11 with a plunger 12 and a male Luer lock connector 13. The syringe 10 can be formed with other types of male connectors. The drug vial 20 has a longitudinal drug vial axis 20A and includes an open topped drug vial bottle 21 having a drug vial crown 22 and a narrow diameter drug vial neck 23. The drug vial crown 22 is sealed by a drug vial stopper 24. The drug vial stopper 24 is sealed by an aluminum band 26. The drug vial 20 contains a medicament 27 in the form of a powder, solid or liquid. The drug vial 20 can be under negative pressure. The liquid vial 30 has a longitudinal liquid vial axis 30A and includes an open topped liquid vial bottle 31 having a liquid vial crown 32 and a narrow diameter liquid vial neck 33. The liquid vial crown 32 is sealed by a liquid vial stopper 34. The liquid vial stopper 34 is sealed by an aluminum band 36. The liquid vial 30 includes liquid contents 37 in the form of diluent only or an active component.

Figure 2:
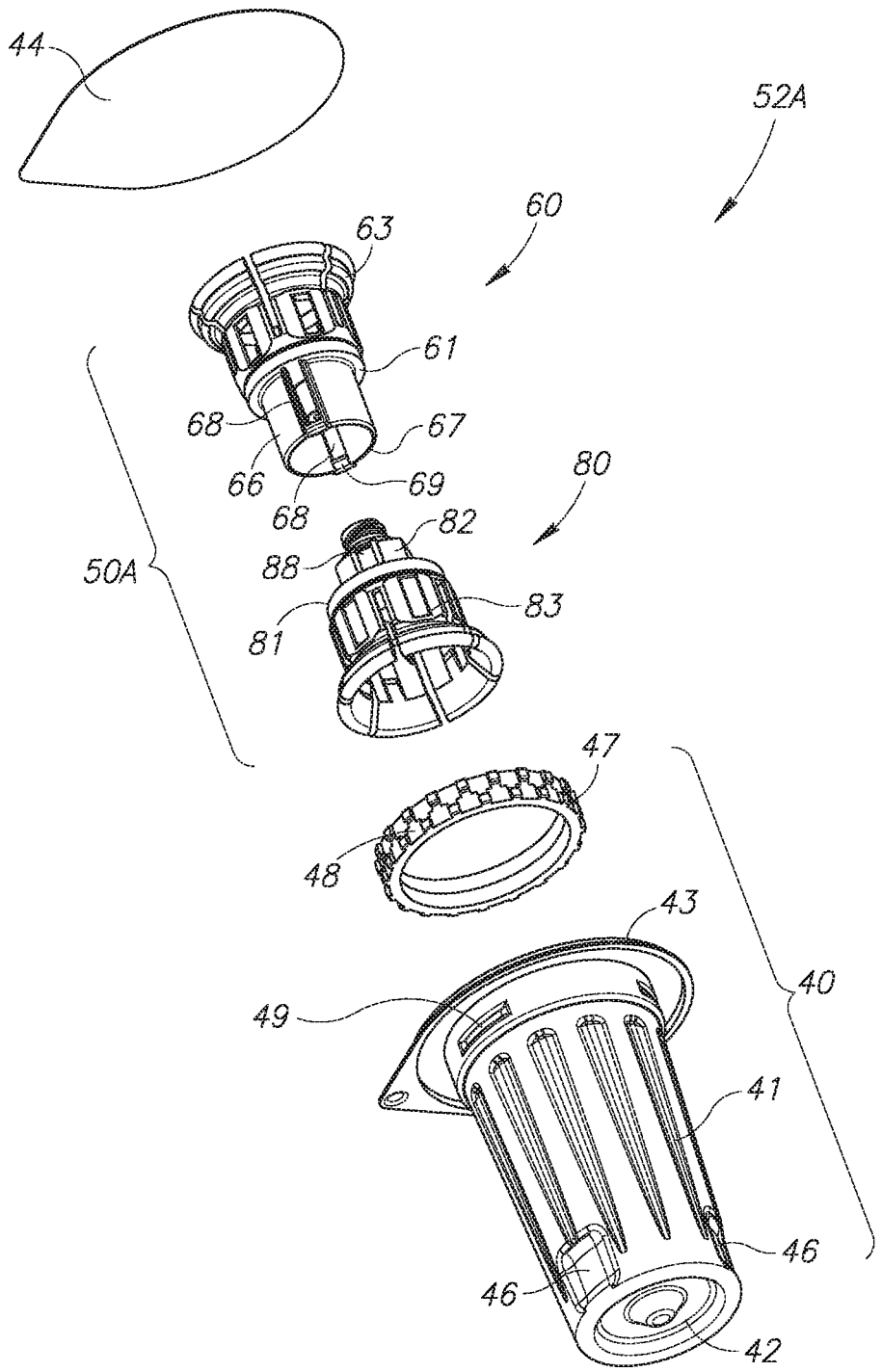
FIG. 2 is a first exploded perspective view of the blister and the dual vial adapter assemblage.
Figure 3:
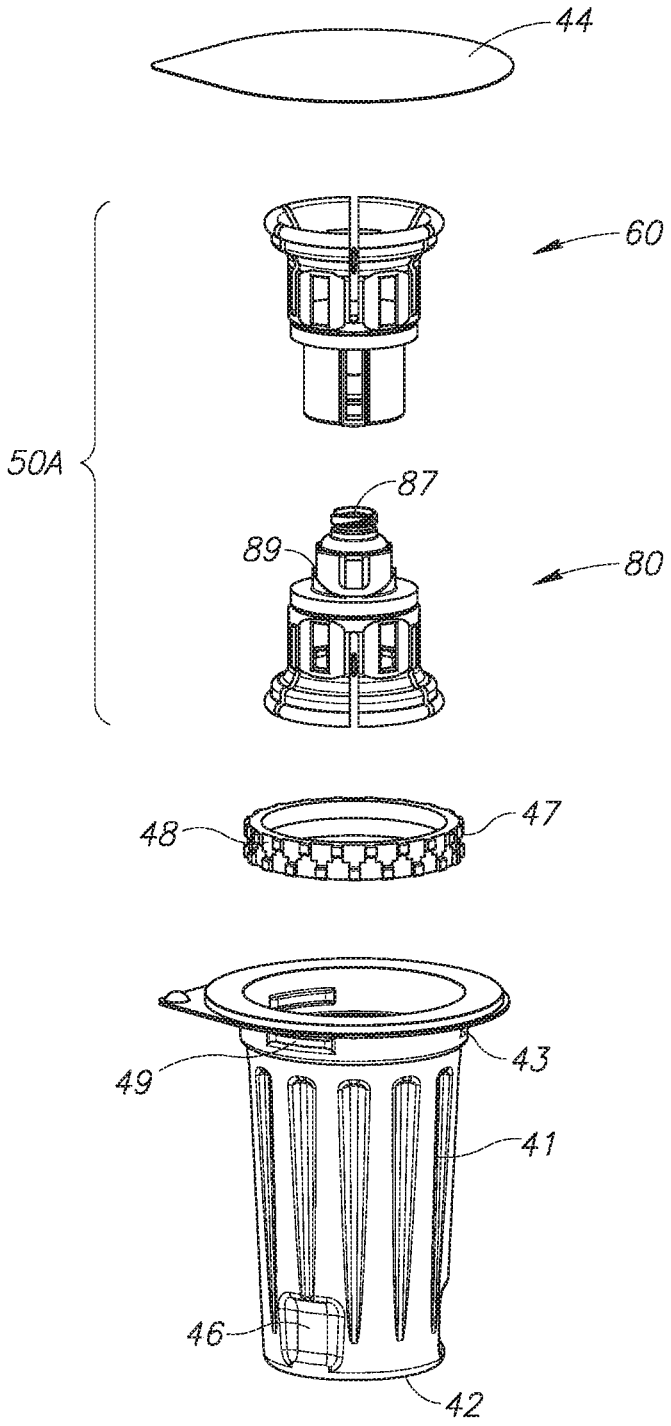
FIG. 3 is a second exploded perspective view of the blister and the dual vial adapter assemblage.

FIGS. 2 to 4 show the blister 40 includes an open ended blister container 41 having a blister container closed end 42 and a blister container open end 43. The blister 40 includes a seal 44 for sealing the open end 43. The blister container closed end 42 includes retainer indentations 46 for keeping the drug vial adapter 80 thereat. The open ended blister container 41 includes an internal rigid restrainer arrangement 47 at its open end 43 for preventing immediate snap fit of the liquid vial adapter 60 on the liquid vial 30 on the initial telescopic mounting of the liquid vial adapter 60 thereon. The internal rigid restrainer arrangement 47 is implemented as a discrete restrainer ring 48 which is snap fitted into place by indentations 49.

The dual vial adapter assemblage 50A has a longitudinal dual vial adapter assemblage centerline 51 and includes a liquid vial adapter 60 and a drug vial adapter 80 initially inter-engaged on the liquid vial adapter 60. The dual vial adapter assemblage 50A has a manual operable flow control arrangement 52A having three operative positions as follows: an initial extended set-up position, an intermediate compacted flow communication position and a final detachment position. Alternative drug vial adapter assemblages can be implemented with different flow control arrangements capable of assuming the intended three operative positions described hereinbelow.

The liquid vial adapter 60 includes a transverse liquid vial adapter top wall 61 with an upright male connector 62 and an opposite directed liquid vial adapter skirt 63 for telescopic mounting on the liquid vial 30. The male connector 62 is preferably a male Luer lock connector. The liquid vial adapter 60 further includes a liquid vial stopper puncturing cannula 64 for puncturing the liquid vial stopper 34 on telescopic mounting the liquid vial adapter 60 on the liquid vial 30. The upright male connector 62 is in flow communication with the liquid vial stopper puncturing cannula 64. The restrainer ring 48 has an internal diameter dimensioned to snugly receive the liquid vial adapter skirt 63 in its non-flexed position and prevents the opening of the liquid vial adapter skirt 63 for snap fitting on the liquid vial 30.

The liquid vial adapter 60 further includes an upright cylindrical sleeve 66 mounted on the transverse liquid vial adapter top wall 61 and encircling the upright male connector 62. The upright cylindrical sleeve 66 has a leading sleeve rim 67 facing the drug vial adapter 80. The cylindrical sleeve 66 is thin walled so that it can resiliently elastically deformed from a non-flexed cylindrical cross section to a slightly deformed elliptical cross section. The cylindrical sleeve 66 has a diametric pair of longitudinal directed closed end elongated slits 68 extending from the transverse liquid vial adapter top wall 61 to the leading sleeve rim 67. The leading sleeve rim 67 has a diametric pair of inward directed hook members 69 aligned with the diametric pair of longitudinal directed closed end elongated slits 68.

The drug vial adapter 80 includes a transverse drug vial adapter top wall 81 with an upright female connector 82 and an opposite directed drug vial adapter skirt 83 for telescopic mounting on the drug vial 20. The female connector 82 is preferably a female Luer connector. The drug vial adapter 80 further includes a drug vial stopper puncturing cannula 84 for puncturing the drug vial stopper 24 on telescopic mounting the drug vial adapter 80 on the drug vial 20. The upright female connector 82 is in flow communication with the drug vial stopper puncturing cannula 84. The upright female connector 82 is fitted with a needlefree swabable self-closing access valve 86 selectively compressible from an uncompressed normally closed state to a compressed flow communication state on a sealing insertion of a male connector therein. The needlefree swabable self-sealing access valve 86 includes a swabable pre-slit access surface 87.

The upright female connector 82 is formed with a diametric pair of longitudinal directed tracks 88 each having an upper track rim 89 and a lower track rim 91. The longitudinal directed tracks 88 are slightly longer than the height of the restrainer ring 48. The longitudinal directed tracks 88 diverge from their upper track rims 89 to their lower track rims 91 such that the lower track rims 91 are further distanced from the longitudinal dual vial adapter assemblage centerline 51 than the upper track rims 89. The upright female connector 82 is formed with a diametric pair of horizontal recesses 92 under the lower track rims 91 adjacent the transverse drug vial adapter top wall 81. The upright female connector 82 is formed with sloping escape ramps 93 on either side of the horizontal recesses 92 such that a manual rotation of the liquid vial adapter 60 relative to the drug vial adapter 80 releases the inward directed hook members 69 from the horizontal recesses 92 and causes them to ride up one of the sloping escape ramps 93 to distance the former 60 from the latter 80.

Figure 4A:
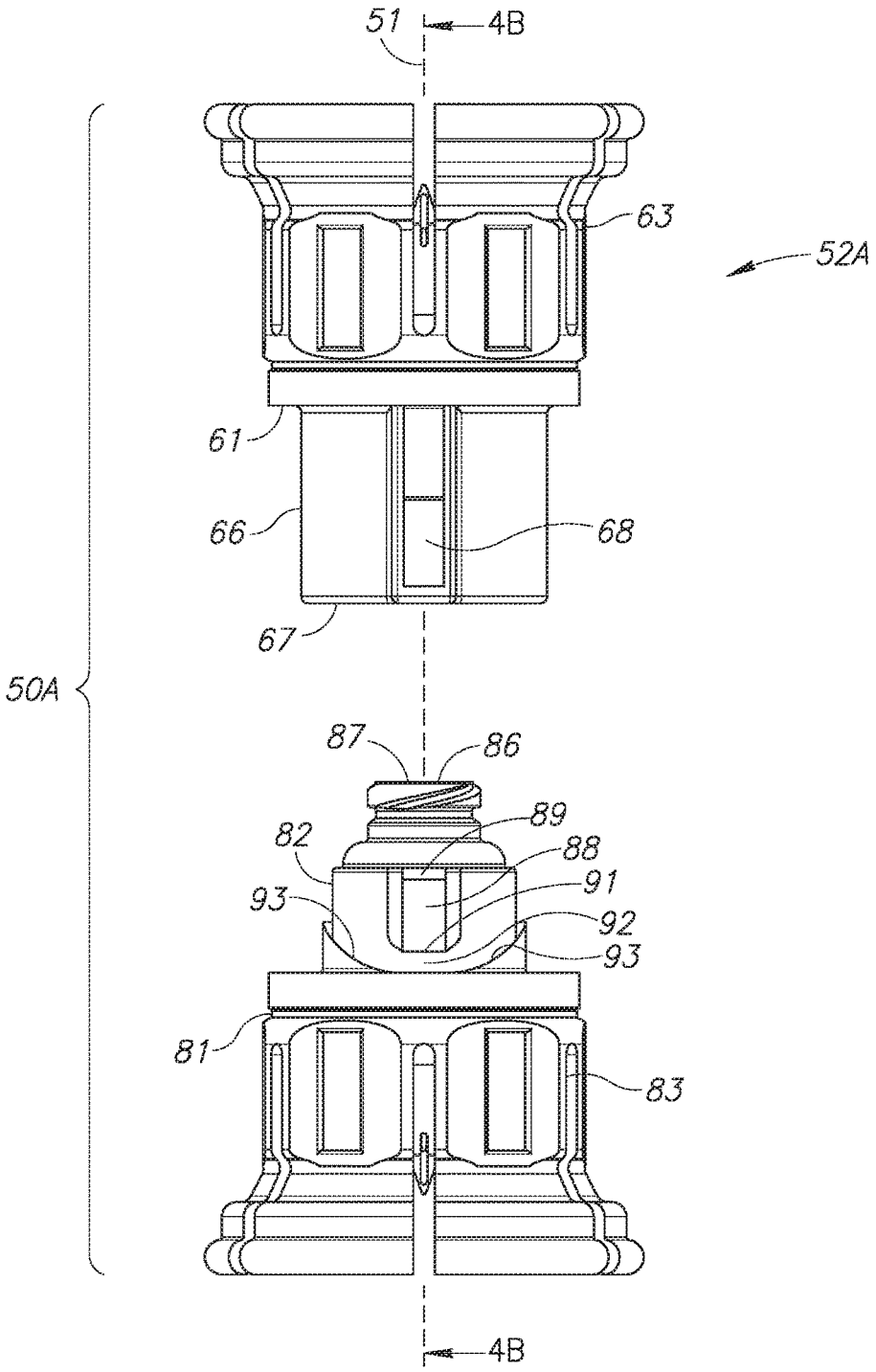
FIG. 4A is an exploded front elevation view of the dual vial adapter assemblage.
Figure 4B:
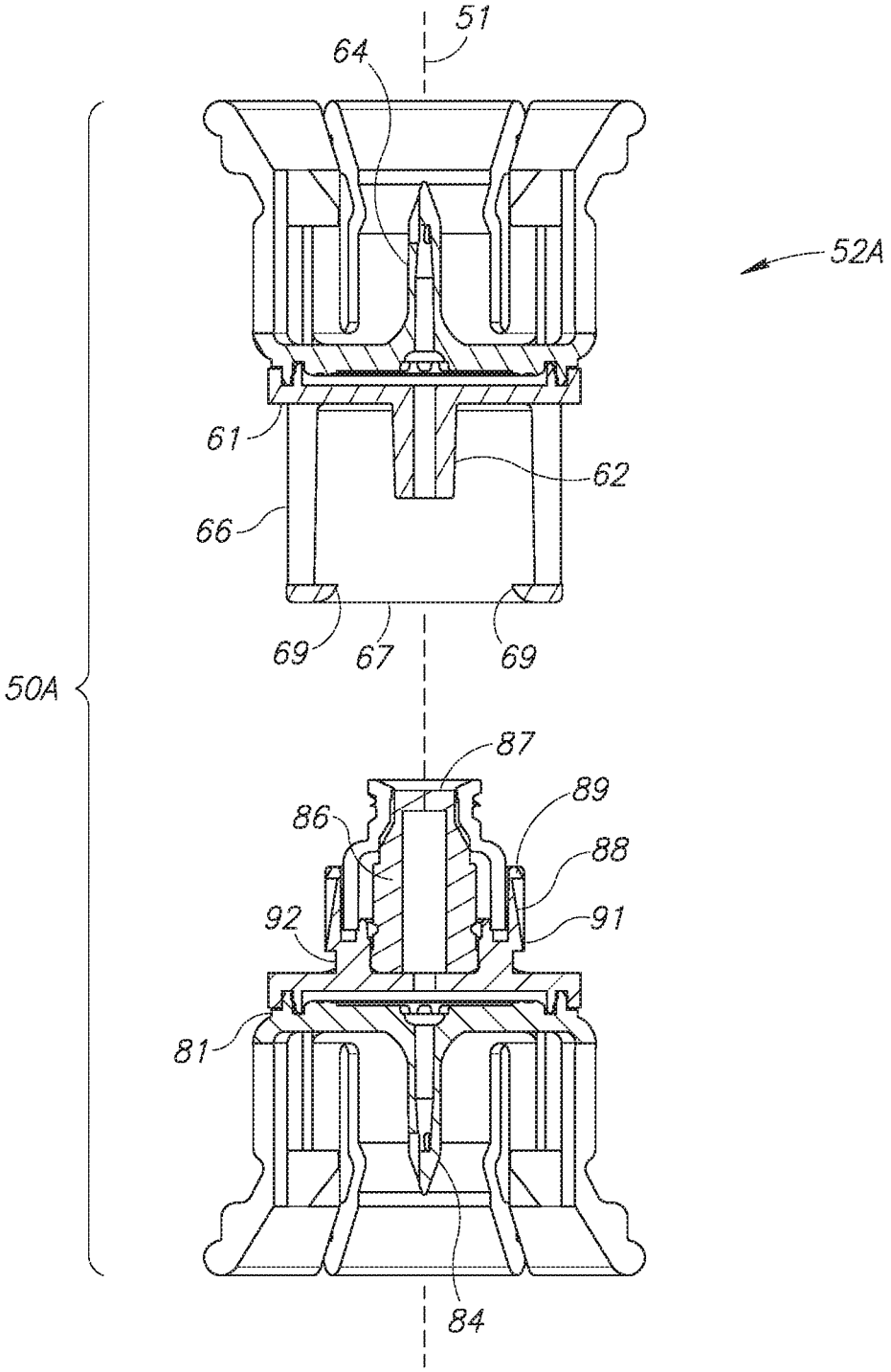
FIG. 4B is a longitudinal cross section of the dual vial adapter assemblage in FIG. 4A along line 4B-4B.
Figure 4C:
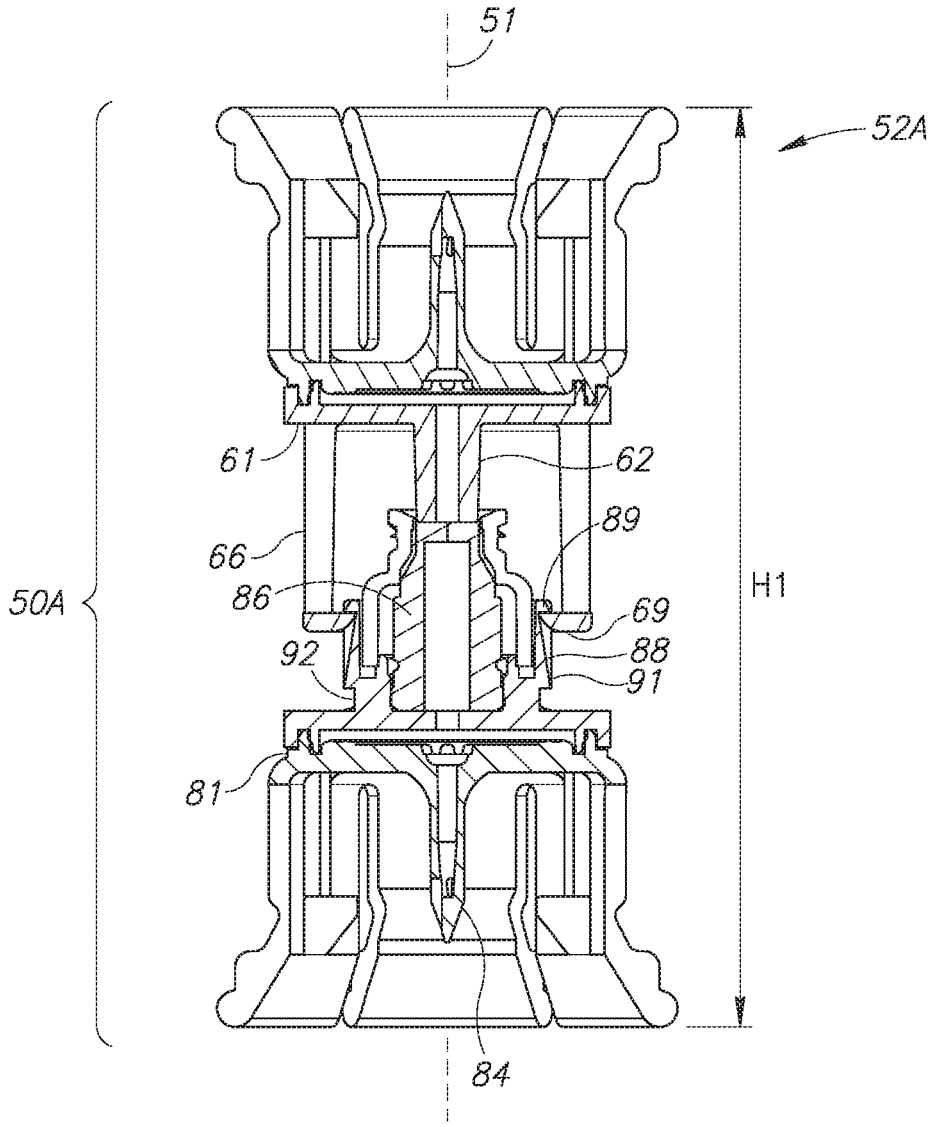
FIG. 4C is a longitudinal cross section of the dual vial adapter assemblage in its initial extended set-up position along line 4B-4B in FIG. 4A.

FIG. 4C shows the flow control arrangement 52A in its extended set-up position with the diametric pair of inward directed hook members 69 deployed at the upper track rims 89 for distancing the liquid vial adapter 60 from the drug vial adapter 80 such that the self-sealing access valve 86 is in its normal closed state suitable for long term storage. The male connector 62 contacts the swabable pre-slit access surface 87 but does not open the self-sealing access valve 86. The dual vial adapter assemblage 50A has an initial extended set-up position height H1.

Figure 4D:
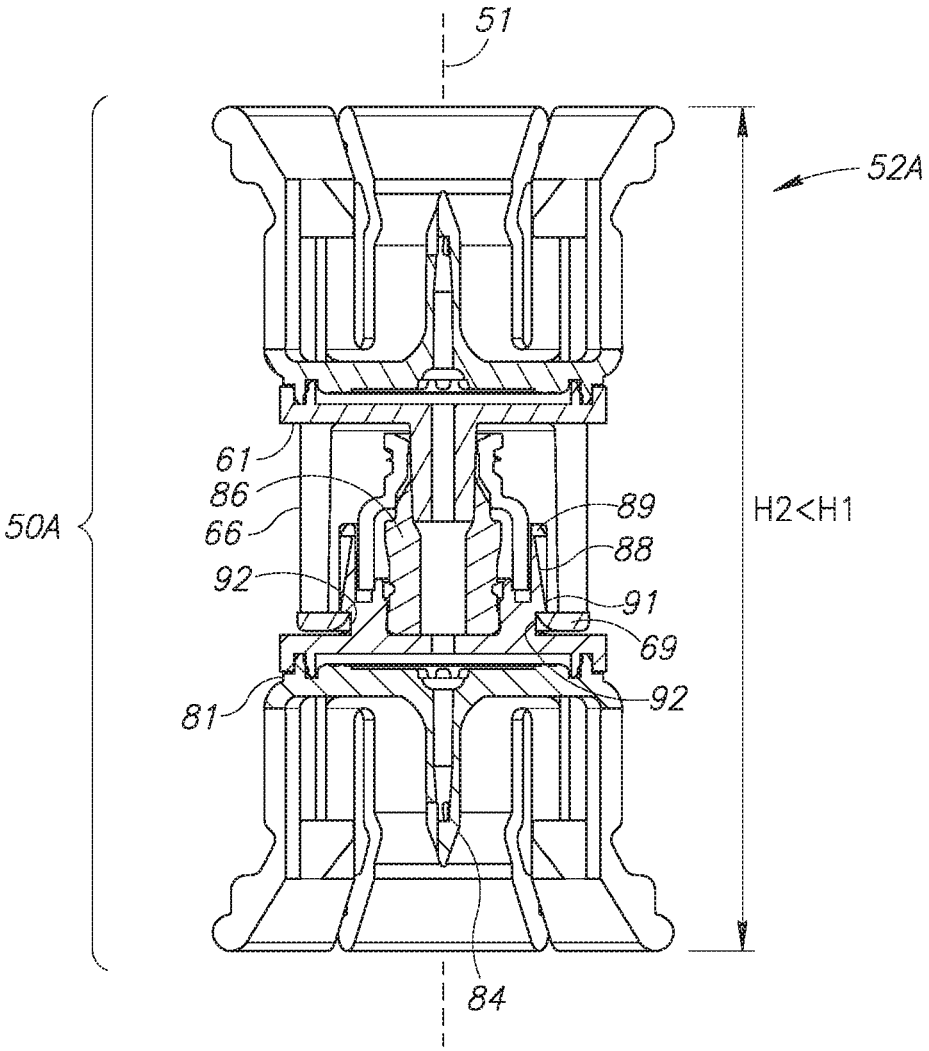
FIG. 4D is a longitudinal cross section of the dual vial adapter assemblage in its intermediate compacted flow communication position along line 4B-4B in FIG. 4A.

FIG. 4D shows the flow control arrangement 52A in its intermediate compacted flow communication position after a linear compaction of the liquid vial adapter 60 towards the drug vial adapter 80. The inward directed hook members 88 are urged down the longitudinal directed tracks 88 and snap over the lower track rims 91 into the horizontal recess 92 thereby ensuring the liquid vial adapter 60 is in secure engagement with the drug vial adapter 80. At the same time, the male connector 62 is inserted into the female connector 82 to open the self-sealing access valve 86 for enabling liquid flow from a liquid vial 30 to a drug vial 20 for liquid drug formation purposes. The dual vial adapter assemblage 50A has an intermediate compacted flow communication position height H2 where H2<H1.

The flow control arrangement 52A has a final detachment position for enabling detachment of the liquid vial adapter 60 from the drug vial adapter 80 on a clockwise or counter clockwise rotation of the liquid vial adapter 60 relative to the drug vial adapter 80 thereby exposing the self-sealing access valve 86. Such release of the liquid vial adapter 60 from the drug vial adapter 80 involves slight elastic deformation of the thin walled cylindrical sleeve 66 from its non-flexed cylindrical cross section to its flexed elliptical cross section. The manual rotation of the liquid vial adapter 60 relative to the drug vial adapter 80 releases the inward directed hook members 69 from the horizontal recesses 92 and causes them to ride up one of the sloping escape ramps 93 to distance the former 60 from the latter 80. The self-sealing access valve 86 reverts to its normally closed state presenting the swabable pre-slit access surface 87.

FIG. 5 to FIG. 11 show the use of the blister 40, the dual vial adapter assemblage 50A and a drug vial 20 under negative pressure. The dual vial adapter assemblage 50A can be equally used without the blister 40 and with a drug vial 20 not under negative pressure.

Figure 5A:
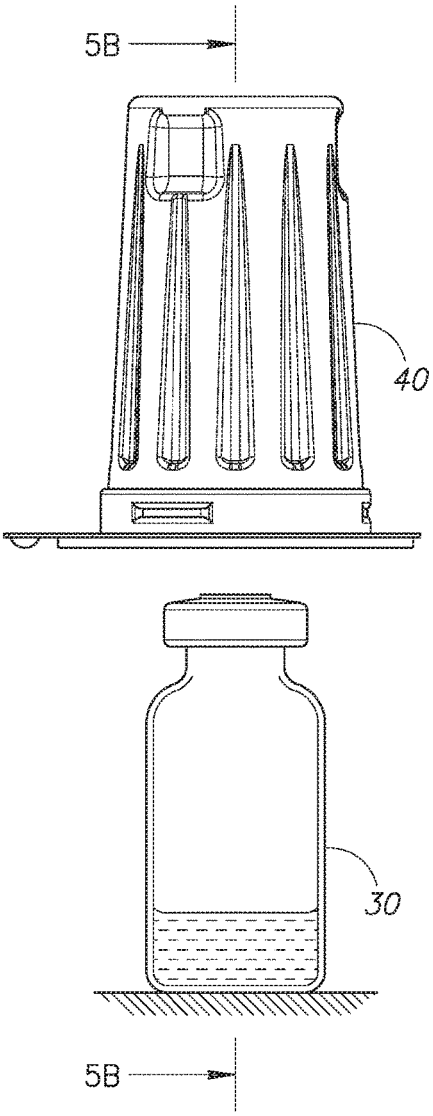
FIG. 5A is a front elevation view of the dual vial adapter assemblage in its extended set-up position in the blister and the liquid vial before telescopic mounting the dual vial adapter assemblage on the liquid vial.
Figure 5B:
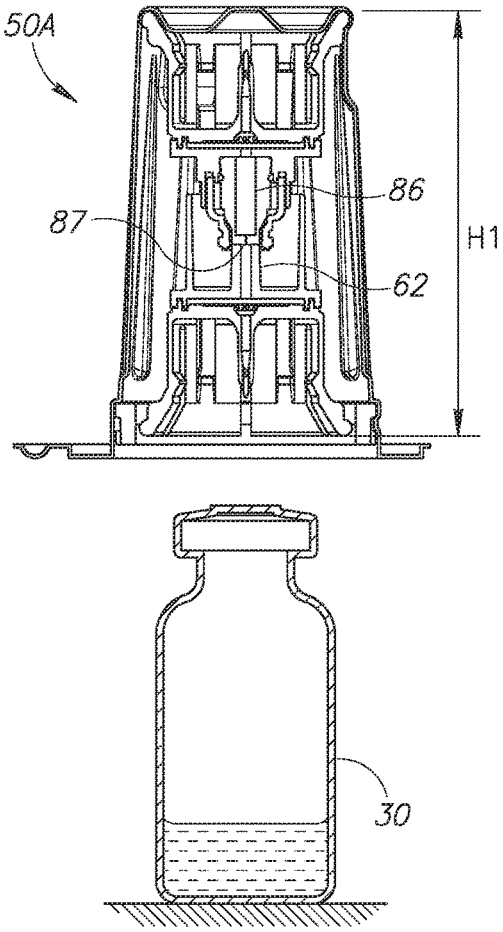
FIG. 5B is a longitudinal cross section of the front elevation view in FIG. 5A along line 5B-5B.

FIGS. 5A and 5B show the dual vial adapter assemblage 50A contained in the blister 40 and the liquid vial 30. The dual vial adapter assemblage 50A is in its initial extended set-up position having an initial extended set-up position height H1.

Figure 6A:
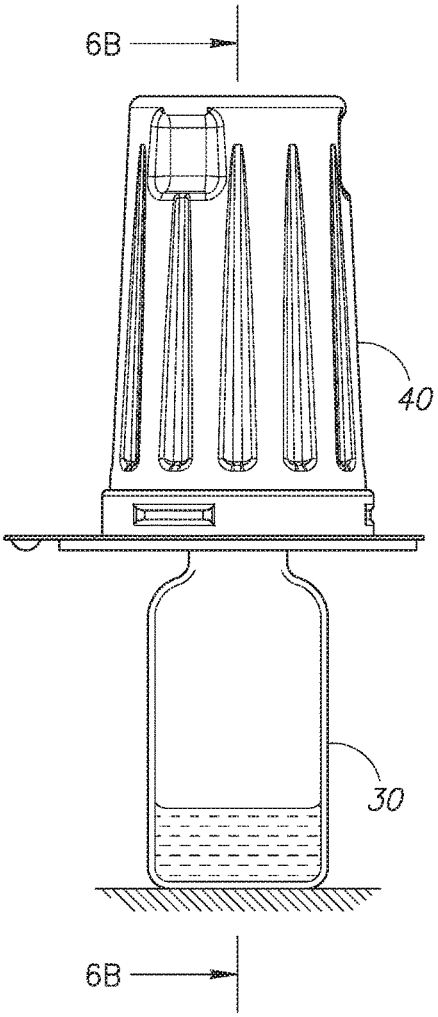
FIG. 6A is a front elevation view of the dual vial adapter assemblage in the blister and the liquid vial adapter contacting the liquid vial.
Figure 6B:
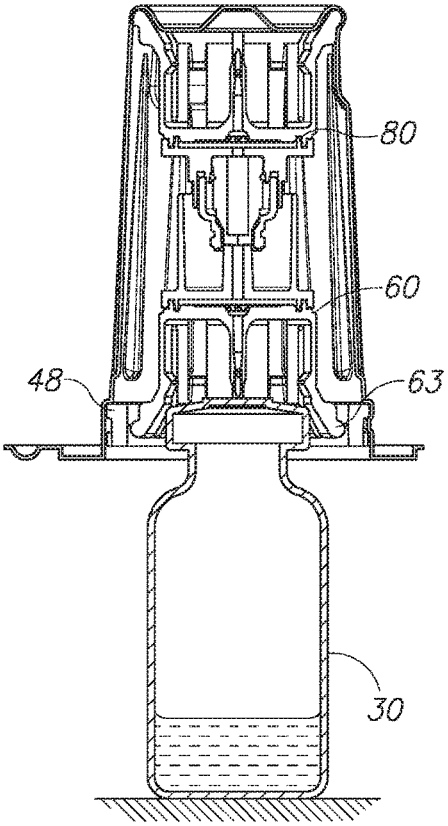
FIG. 6B is a longitudinal cross sectional of the front elevation view in FIG. 6A along line 6B-6B.

FIGS. 6A and 6B show the liquid vial adapter 60 contacting liquid vial 30.

Figure 7A:
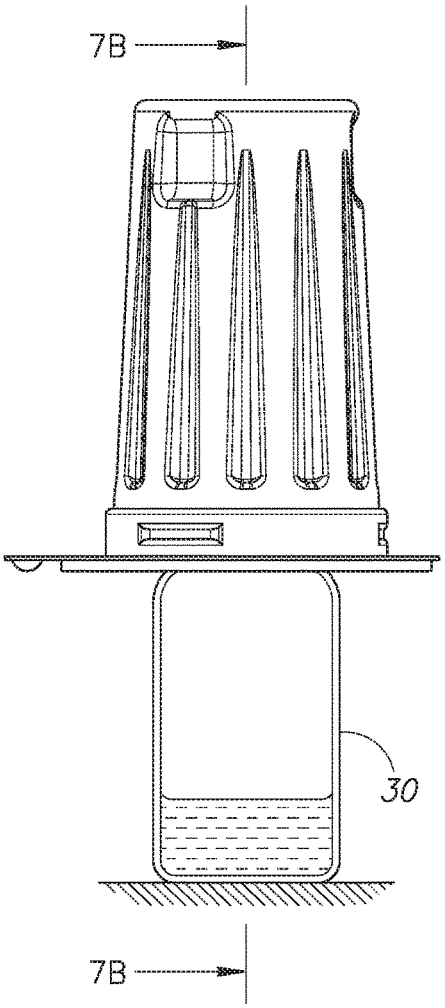
FIG. 7A is a front elevation view showing the liquid vial urging the manual operable flow control arrangement into its intermediate compacted flow communication position on initial telescopic mounting the dual vial adapter assemblage thereon.
Figure 7B:
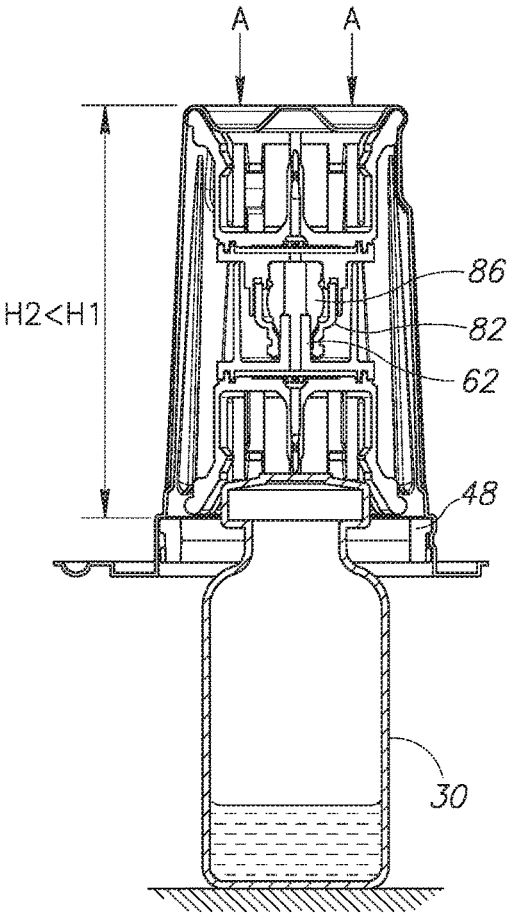
FIG. 7B is a longitudinal cross sectional of the front elevation view in FIG. 7A along line 7B-7B.

FIGS. 7A and 7B show a manual linear compaction force denoted by arrow A on the blister 40 for pushing the liquid vial adapter 60 onto the liquid vial 30 but the rigid restrainer ring 48 prevents the liquid vial adapter skirt 63 from opening. The manual linear compaction force urges the inward directed hook members 69 along the diametric pair of longitudinal tracks 88 over the lower track rims 91 into the diametric pair of horizontal recesses 92 on elastic deformation of the thin-walled cylindrical sleeve 66. The male connector 62 is inserted into the female connector 82 to fully longitudinally compress the self-sealing access valve 86 to its flow communication state for enabling flow communication between the liquid vial stopper puncturing cannula 64 and the drug vial stopper puncturing cannula 84. The liquid vial adapter 60 clears the restrainer ring 48. The dual vial adapter assemblage 50A has an intermediate compacted flow communication position height H2 where H2<H1.

Figure 8A:
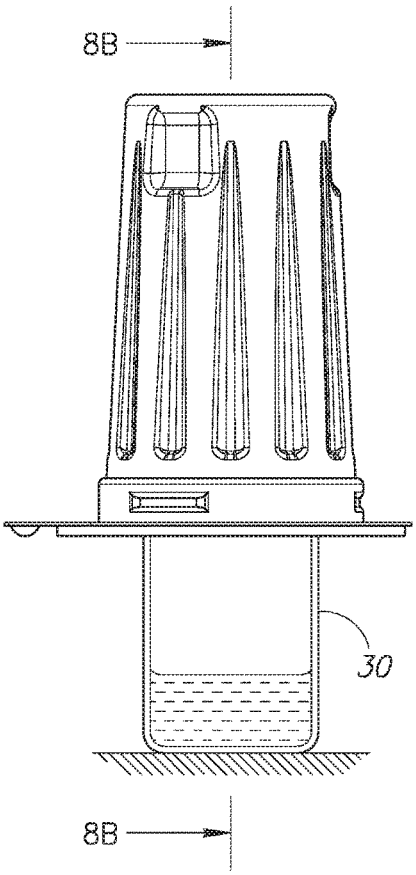
FIG. 8A is a front elevation view of the dual vial adapter assemblage in the blister with the liquid vial adapter puncturing the liquid vial.
Figure 8B:
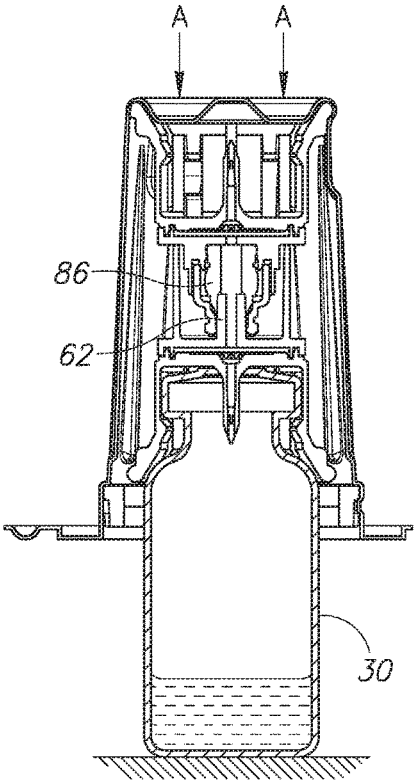
FIG. 8B is a longitudinal cross sectional of the front elevation view in FIG. 8A along line 8B-8B.

FIGS. 8A and 8B show continued linear manual compaction force further pushes the liquid vial adapter 60 onto the liquid vial 30 such that the liquid vial adapter 60 snap fits onto the liquid vial 30 thereby puncturing its liquid vial stopper 34.

Figure 9A:
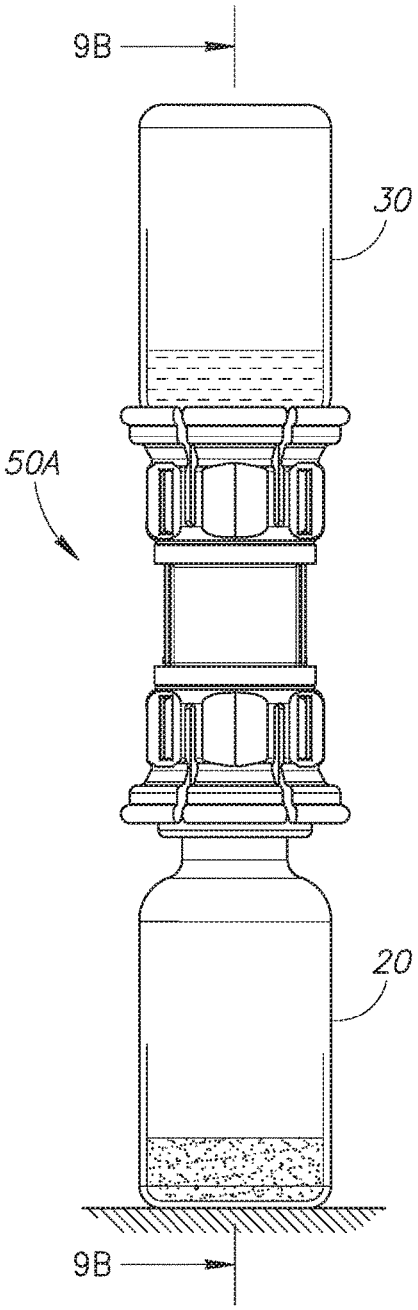
FIG. 9A is a front elevation view showing removal of the dual vial adapter assemblage from the blister and inversion of the dual vial adapter assemblage for placement of the drug vial adapter on the drug vial without puncturing the drug vial.
Figure 9B:
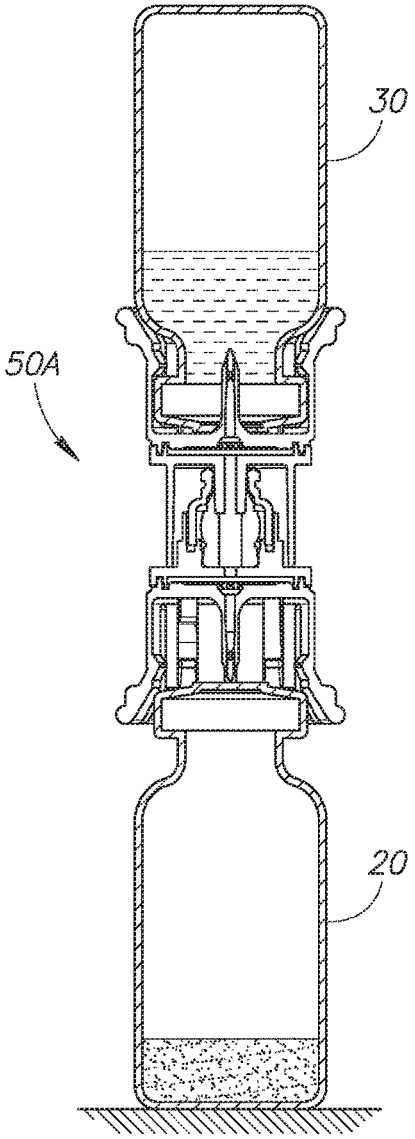
FIG. 9B is a longitudinal cross section of the front elevation view in FIG. 9A along line 9B-9B.

FIGS. 9A and 9B show removal of the dual vial adapter assemblage 50A from the blister 40 and inversion of the dual vial adapter assemblage 50A for placement of the drug vial adapter 80 on the drug vial 20 without puncturing same.

Figure 10A:
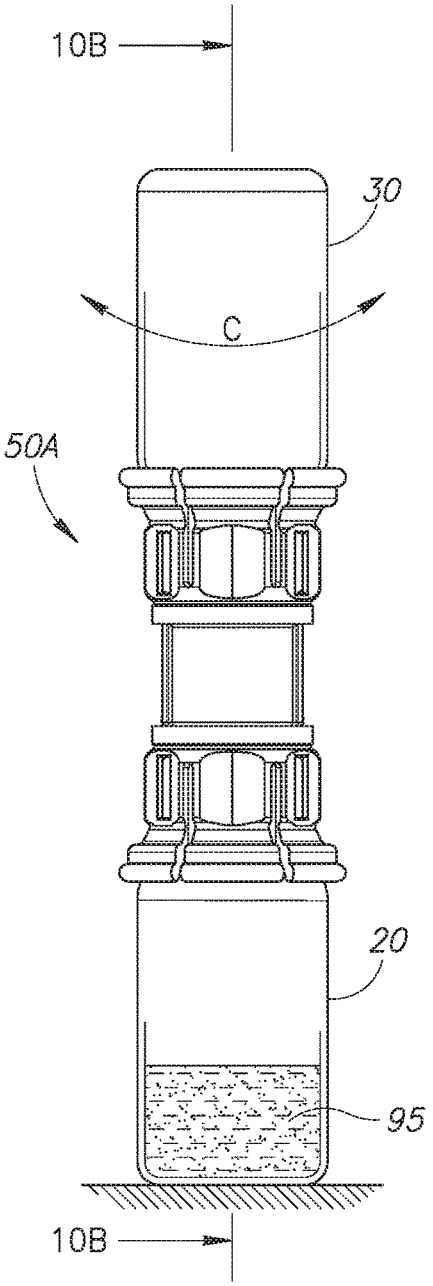
FIG. 10A is a front elevation view showing the drug vial adapter puncturing the drug vial for withdrawing diluent from the liquid vial into the drug vial for forming liquid drug contents in the drug vial.
Figure 10B:
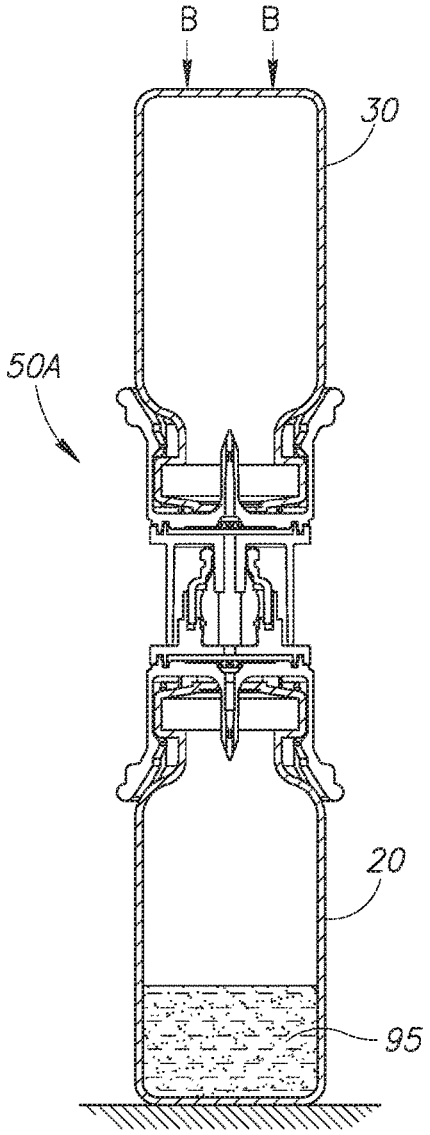
FIG. 10B is a longitudinal cross section of the front elevation view in FIG. 10A along line 10B-10B.

FIGS. 10A and 10B show a manual linear compaction force denoted by arrow B on the liquid vial 30 for pushing the drug vial adapter 80 onto the drug vial 20 for puncturing same. The drug vial 20 under negative pressure withdraws the liquid contents from the liquid vial 30 thereinto the drug vial 20 for formation of liquid drug contents 95 therein. The liquid vial 30 is now empty and the drug vial 20 now contains liquid drug contents 95.

Figure 11A:
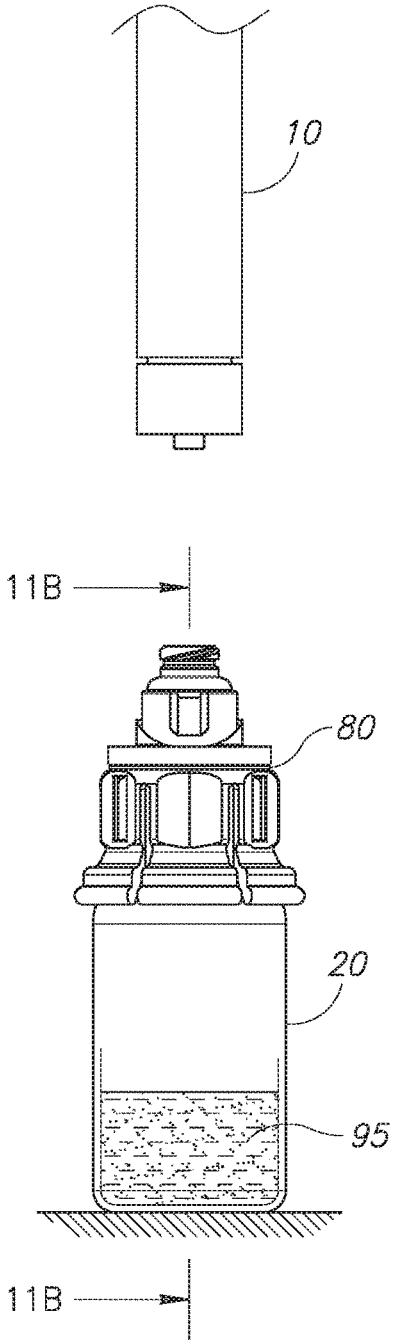
FIG. 11A is a front elevation view showing attachment of a syringe to the drug vial adapter for aspiration of liquid drug contents from the drug vial.
Figure 11B:
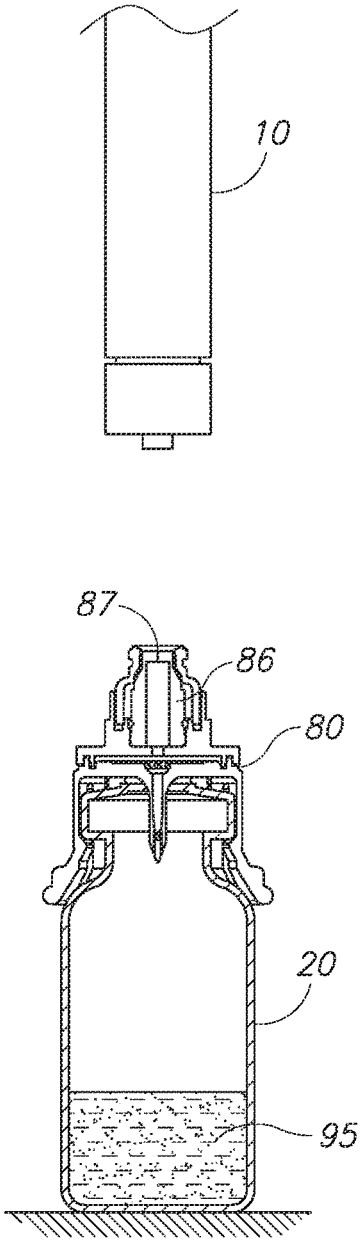
FIG. 11B is a longitudinal cross section of the front elevation view in FIG. 11A along line 11B-11B.

FIGS. 11A and 11B show the drug vial adapter 80 is ready for syringe aspiration of liquid drug 95 from the drug vial 20 after detachment of the liquid vial adapter 60 and the empty liquid vial 30 from the drug vial adapter 80 by either clockwise or counterclockwise rotation of the liquid vial adapter 60 relative thereto as denoted by arrow C in FIG. 10A.

Figure 12:
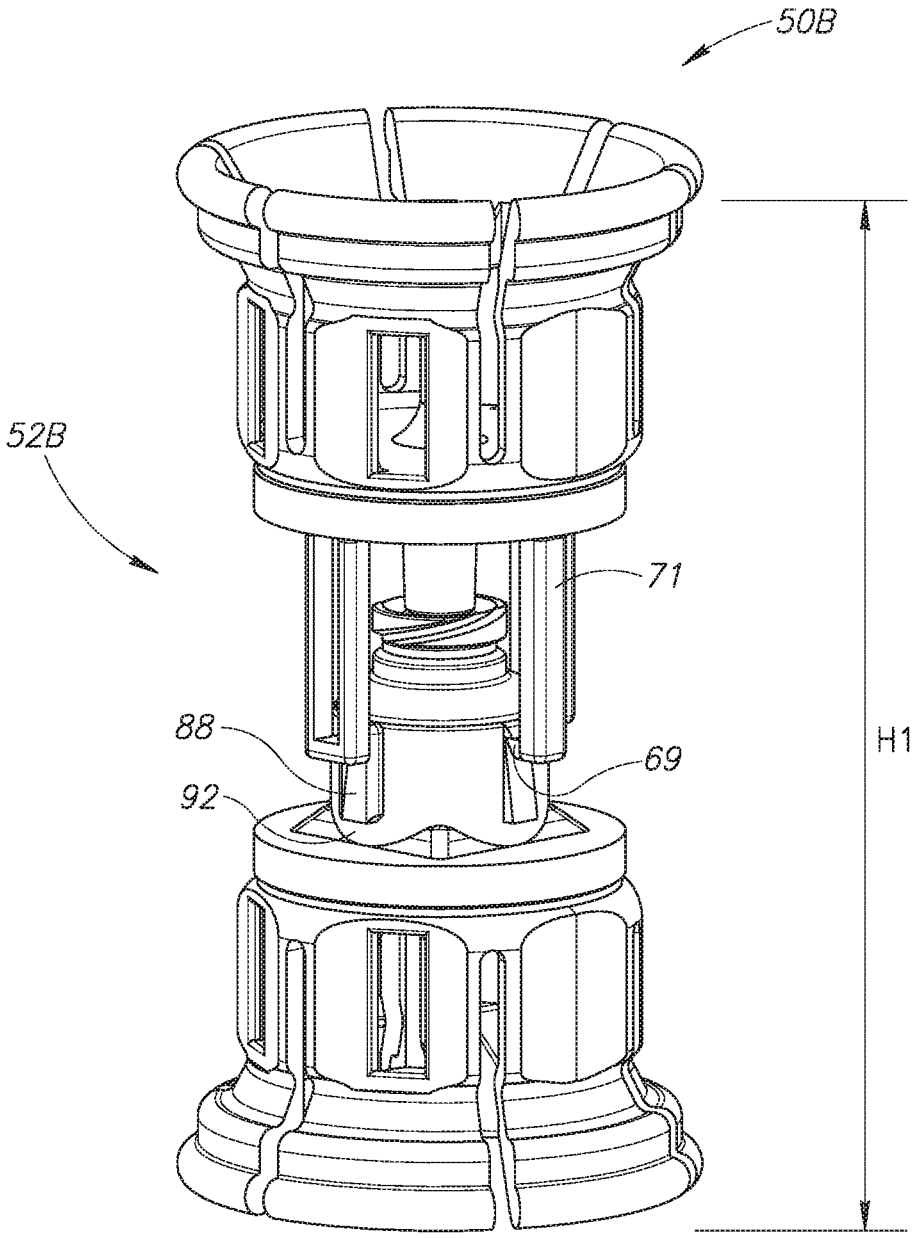
FIG. 12 is a perspective view of a dual vial adapter assemblage in its initial extended set-up position in accordance with a second embodiment of the present invention.
Figure 13:
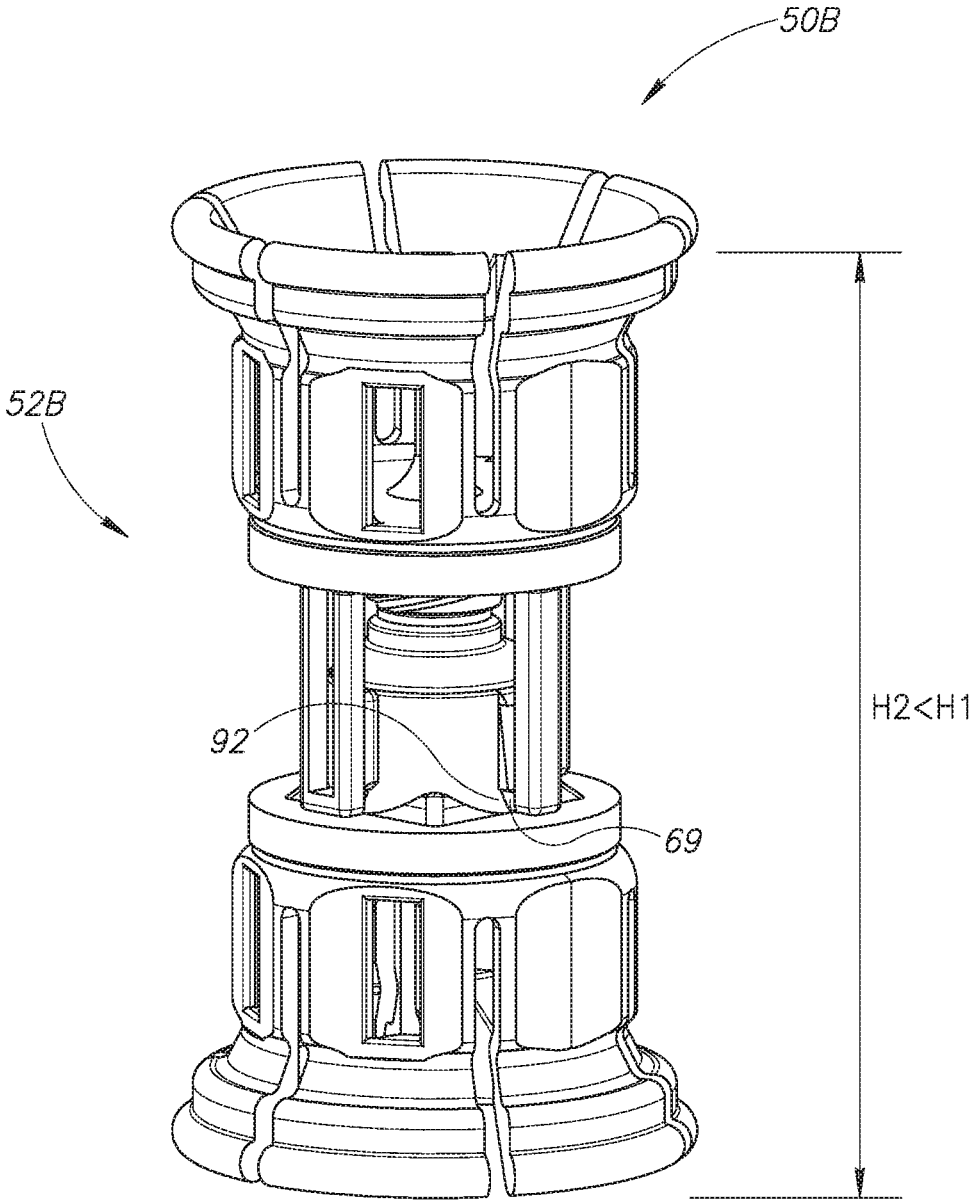
FIG. 13 is a perspective view of the FIG. 12 dual vial adapter assemblage in its intermediate compacted flow communication position.
Figure 14:
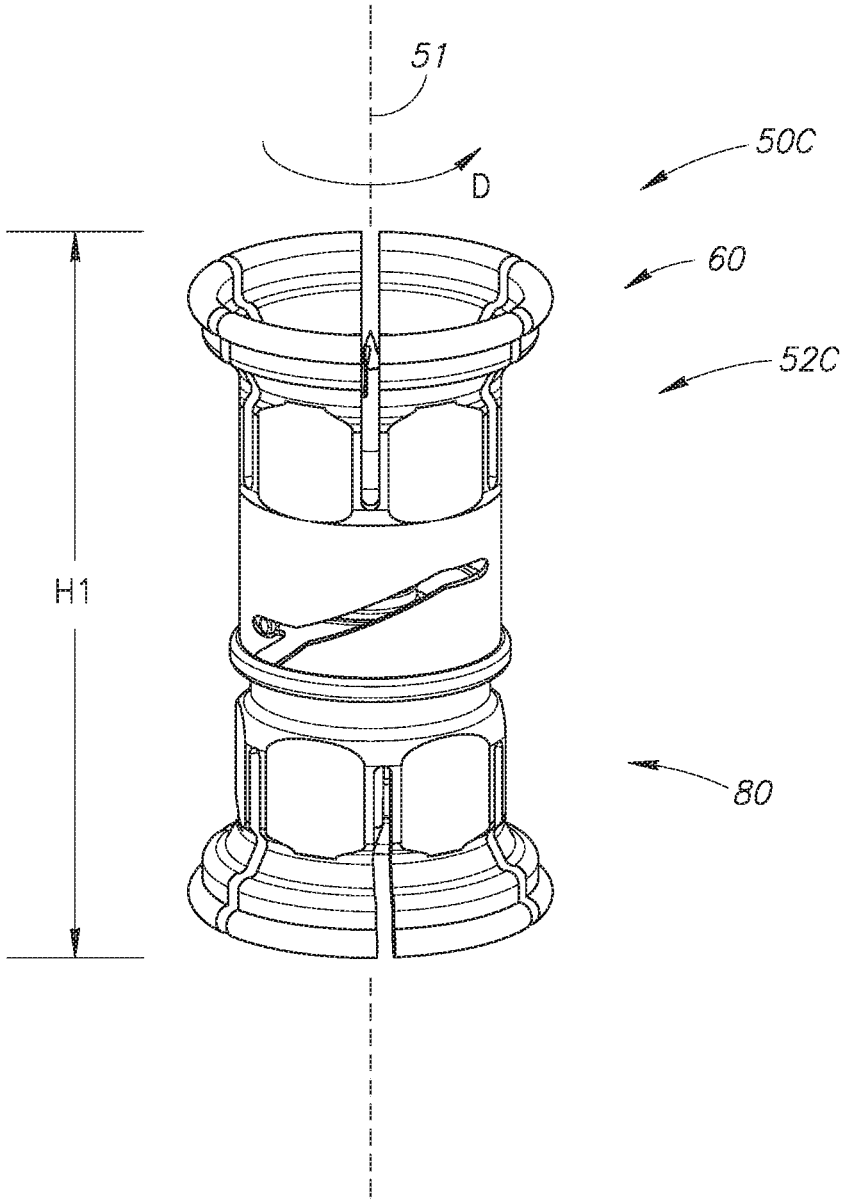
FIG. 14 is a perspective view of a dual vial adapter assemblage in its initial extended set-up position in accordance with a third embodiment of the present invention.
Figure 15:
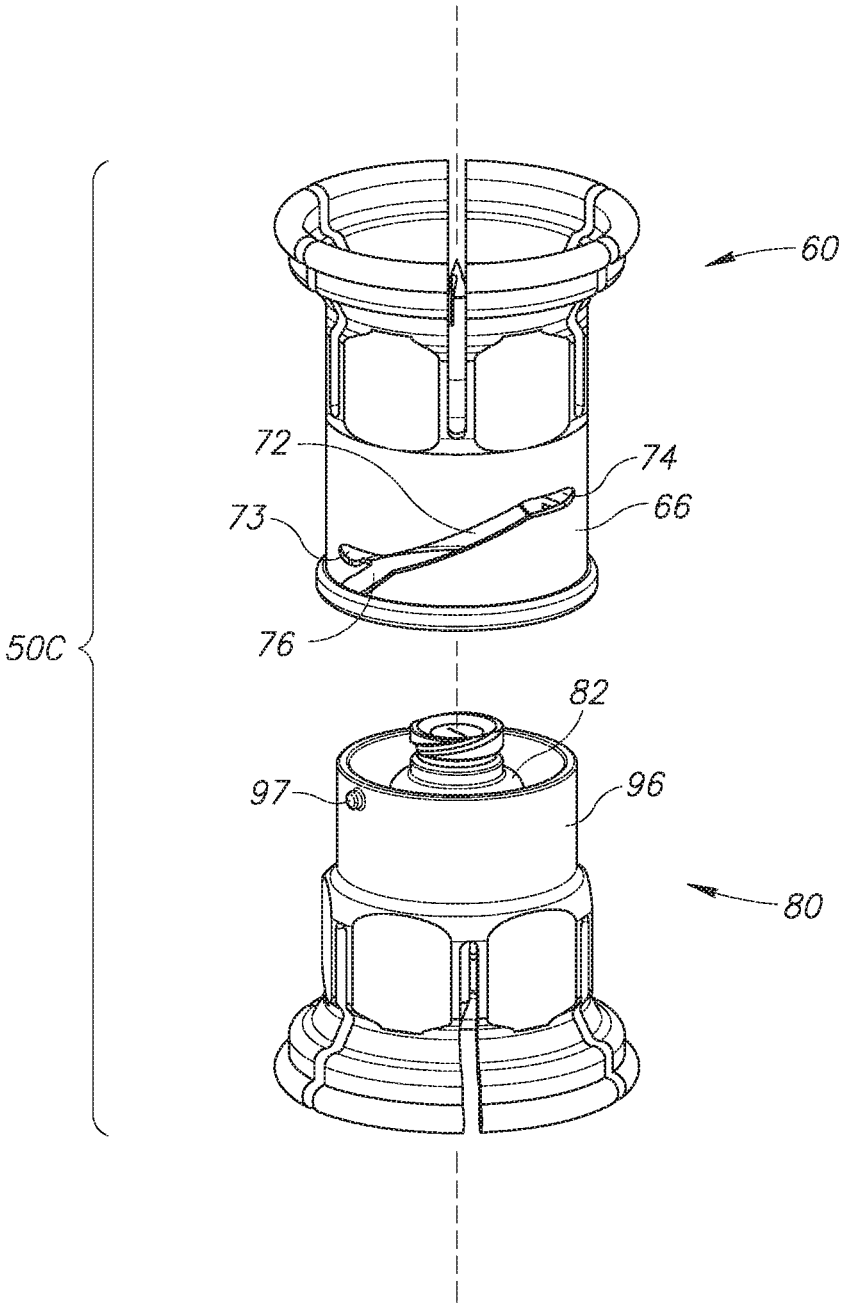
FIG. 15 is an exploded view of the FIG. 14 dual vial adapter assemblage.

FIGS. 12 and 13 show a dual vial adapter assemblage 50B having a construction and operation similar to the dual vial adapter assemblage 50A and therefore similar parts are likewise numbered. The latter 50B differs from the former 50A insofar as the latter 50B has a manual operable flow control arrangement 52B having four equispaced longitudinally directed resiliently flexible supports 71 each having an inward directed hook member 69. Accordingly, the manual operable flow control arrangement 52B has a corresponding number of longitudinal directed tracks 82 each having its upper track rim 89, lower track rim 91, and horizontal recess 92.

FIGS. 14 to 17 show a dual vial adapter assemblage 50C having a construction and operation similar to the dual vial adapter assemblage 50A and therefore similar parts are likewise numbered. The latter 50C differs from the former 50A insofar that the latter 50C has a manual operable flow control arrangement 52C in the form of a bayonet arrangement including at least one pin and groove pair and preferably a diametric pair of a pin and groove pair. The flow control arrangement 52C is urged from an initial extended set-up position to an intermediate compacted flow communication position on undergoing a rotational compaction as opposed to a linear compaction.

The liquid vial adapter 60 is formed with an upright cylindrical sleeve 66 with a diametric pair of Y-shaped grooves 72. The generally Y-shaped grooves 72 each include a first closed end 73, a second closed end 74 opposite the first closed end 73, and an open end 76 adjacent the closed end 73. The drug vial adapter 80 is formed with an upright cylindrical sleeve 96 encircling the female connector 82. The upright cylindrical sleeve 96 is shaped and dimensioned to be telescopically received within the upright cylindrical sleeve 66 on disposing the dual vial adapter assemblage 50C from its initial extended set-up position to its intermediate compacted flow communication position. The upright cylindrical sleeve 96 is formed with a diametric pair of outward directed pins 97 for sliding along the Y-shaped grooves 72. The pins 97 are located at the first closed ends 73 at the initial extended set-up position, the second closed ends 74 at the intermediate compacted flow communication position and the open ends 76 at the detachment position.

Figure 16A:
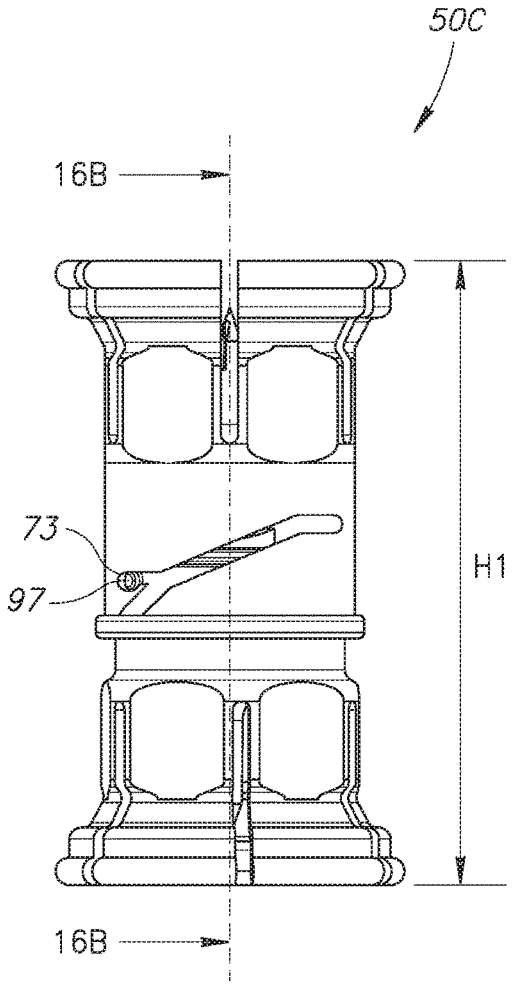
FIG. 16A is a front elevation view of the FIG. 14 dual vial adapter assemblage in its initial extended set-up position.
Figure 16B:
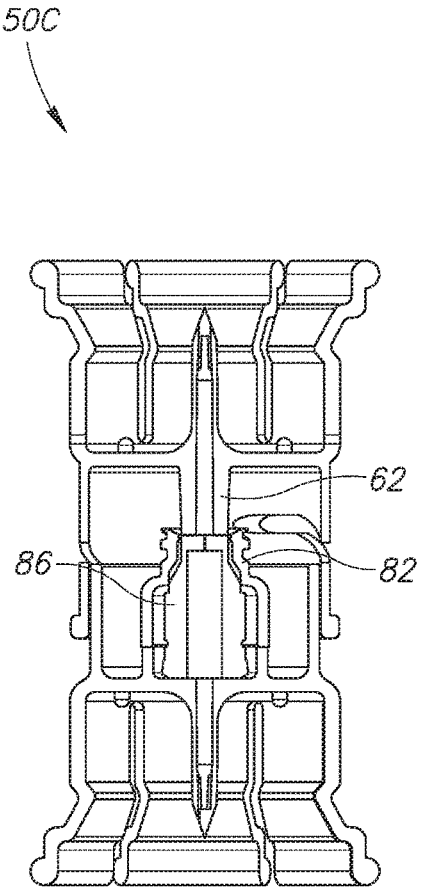
FIG. 16B is a longitudinal cross section of the FIG. 14 dual vial adapter assemblage in FIG. 16A along line 16B-16B.

The flow control arrangement 52C has the following three positions: FIGS. 16A and 16B show the initial extended set-up position in which the dual vial adapter assemblage 50C has the initial extended set-up position height H1. The liquid vial adapter 60 engages the drug vial adapter 80 without the male connector 62 being inserted into the female connector 82 such that the self-sealing access valve 86 remains closed. The pins 97 are located at the first closed ends 73.

Figure 17A:
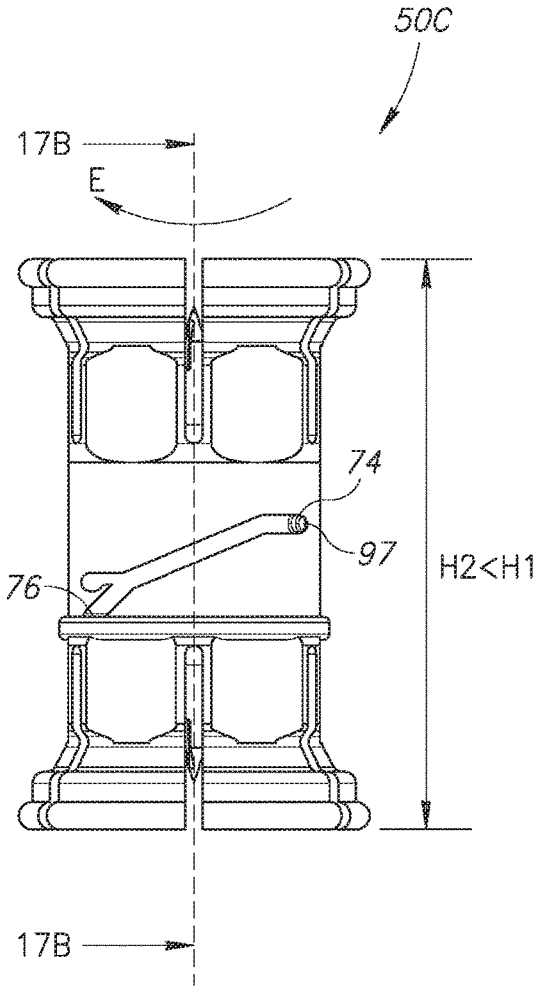
FIG. 17A is a front elevation view of the FIG. 14 dual vial adapter assemblage in its intermediate compacted flow communication position.
Figure 17B:
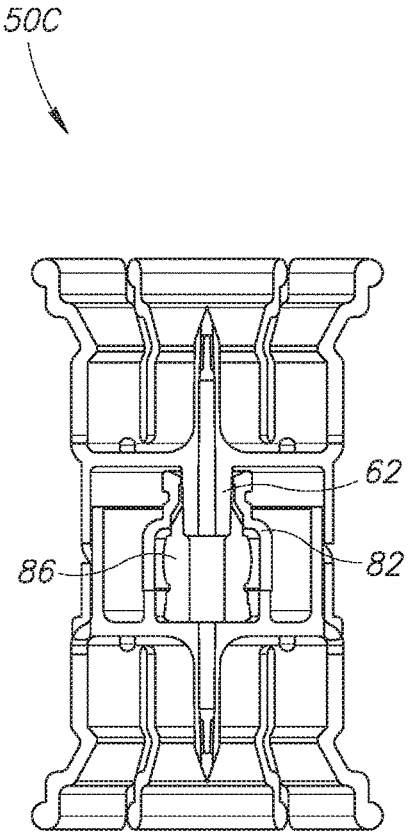
FIG. 17B is a longitudinal cross section of the FIG. 14 dual vial adapter assemblage in FIG. 17A along line 17B-17B.

FIGS. 17A and 17B shows the intermediate compacted flow communication position in which the dual vial adapter assemblage 50C has the intermediate compacted flow communication position height H2. The liquid vial adapter 60 engages the drug vial adapter 80 for urging the male connector 62 into the female connector 82 to longitudinally compress the self-sealing access valve 86 to open same. The pins 97 are located at the second closed ends 74 after clockwise rotation of the liquid vial adapter 60 relative to a stationary drug vial adapter 80 around the longitudinal dual vial adapter assemblage centerline 51 as denoted by arrow D in FIG. 14.

A final detachment position for enabling detachment of the liquid vial adapter 60 from the drug vial adapter 80 on counterclockwise rotation of the liquid vial adapter 60 relative thereto around the longitudinal dual vial adapter assemblage centerline 51 as denoted by arrow E in FIG. 17A. The pins 97 are located at the open ends 76 for detachment purposes.

Figure 18A:
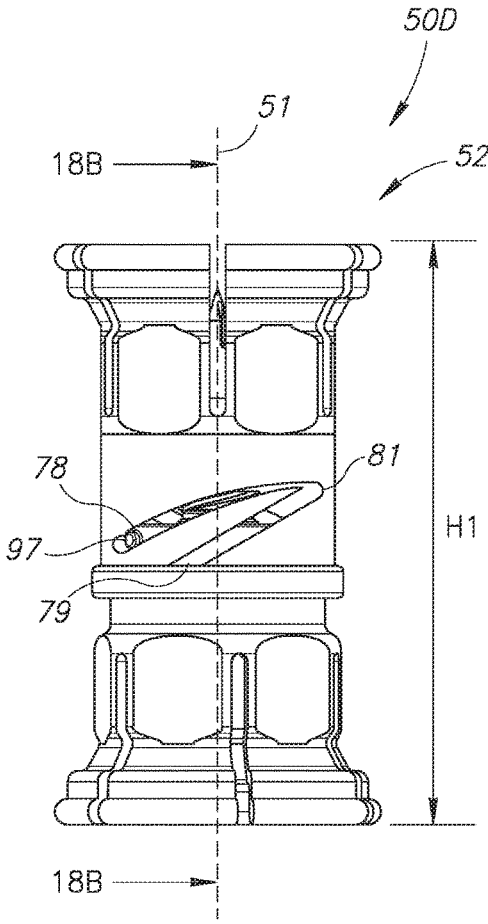
FIG. 18A is a front elevation view of a dual vial adapter assemblage in its initial extended set-up position in accordance with a fourth embodiment of the present invention.
Figure 18B:
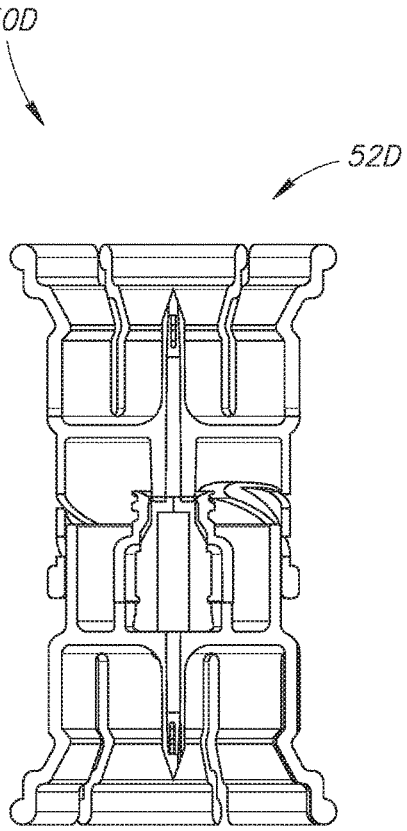
FIG. 18B is a longitudinal cross section of the dual vial adapter assemblage in FIG. 18A along line 18B-18B.
Figure 19A:
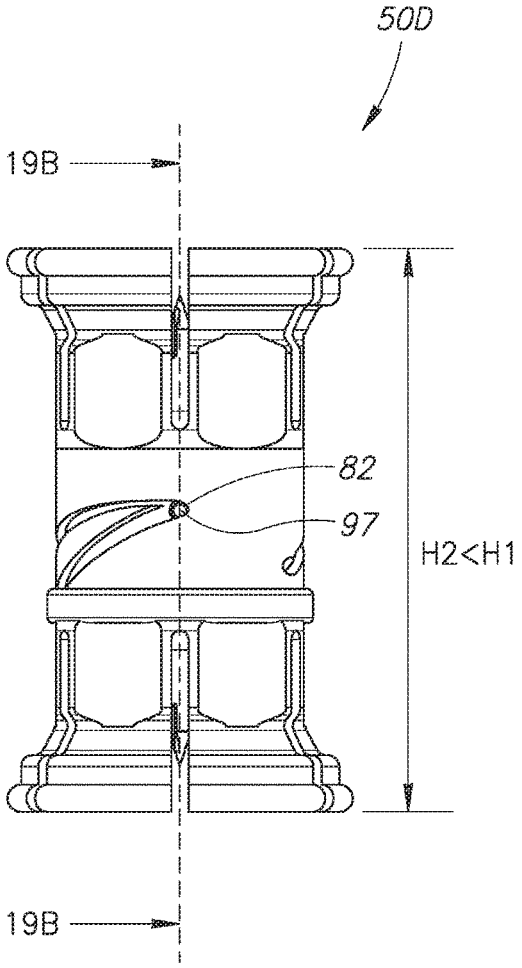
FIG. 19A is a front elevation view of the FIG. 18A dual vial adapter assemblage in its compacted flow communication position.
Figure 19B:
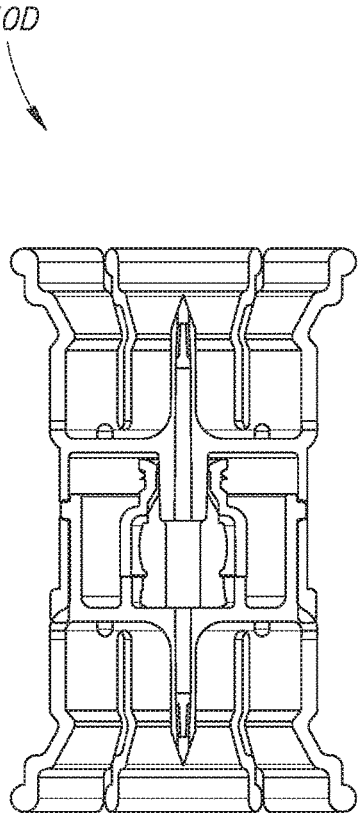
FIG. 19B is a longitudinal cross section of the dual vial adapter assemblage in FIG. 19A along line 19B-19B.

FIGS. 18 and 19 show a dual vial adapter assemblage 50D similar in construction and operation as the dual vial adapter assemblage 50C and therefore similar parts are likewise numbered. The flow control arrangement 52D is also urged from an initial extended set-up position to an intermediate compacted flow communication position on undergoing a rotational compaction as opposed to a linear compaction. The dual vial adapter assemblage 50D has a manual operable flow control arrangement 52D which differs from the manual operable flow control arrangement 52C insofar as the latter 50D includes a diametric pair of inverted inclined generally U-shaped grooves 77 instead of the diametric pair of Y-shaped grooves 72. The inverted inclined generally U-shaped grooves 77 each include a closed end 78, an open end 79 and a curved apex 81 between the closed end 78 and the open end 79. The pins 97 are located at the closed ends 78 at the initial extended set-up position, the curved apices 81 at the intermediate compacted flow communication position and the open ends 79 at the final detachment position.

While particular embodiments of the present invention are illustrated and described, it would be obvious to those skilled in the art that various other changes and modifications can be made without departing from the spirit and scope of the invention.

The invention claimed is:

1. A dual vial adapter assemblage for use with a needleless syringe having a male connector, a drug vial, and a liquid vial, the drug vial having a drug vial bottle and a drug vial stopper sealing the drug vial bottle, the drug vial containing a medicament, the liquid vial having a liquid vial bottle and a liquid vial stopper sealing the liquid vial bottle, the liquid vial containing liquid contents for mixing or reconstituting the medicament in the drug vial to form liquid drug contents therein, the dual vial adapter assemblage having a longitudinal dual vial adapter assemblage centerline and comprising:

(a) a drug vial adapter including a transverse drug vial adapter top wall with an upright female connector, an oppositely directed drug vial adapter skirt for telescopic mounting on the drug vial, and a drug vial stopper puncturing cannula for puncturing the drug vial stopper on said telescopic mounting said drug vial adapter on the drug vial, said upright female connector being in flow communication with said drug vial stopper puncturing cannula, said upright female connector having a needlefree swabable self-sealing access valve selectively longitudinal compressible from an uncompressed normally closed state to a compressed open flow communication state on a sealing insertion of a male connector therein;

(b) a liquid vial adapter including a transverse liquid vial adapter top wall with an upright male connector, an oppositely directed liquid vial adapter skirt for telescopic mounting on the liquid vial and a liquid vial stopper puncturing cannula for puncturing the liquid vial stopper on said telescopic mounting said liquid vial adapter on the liquid vial, said upright male connector being in flow communication with said liquid vial stopper puncturing cannula; and (c) a manual operable flow control arrangement having two operative positions including:

i) a compacted flow communication position in which said liquid vial adapter engages said drug vial adapter with said male connector being urged into said female connector to longitudinally compress said self-sealing access valve to said open flow communication state for enabling flow communication between said drug vial stopper puncturing cannula and said liquid vial stopper puncturing cannula for enabling formation of the liquid drug in the drug vial and wherein the dual vial adapter assemblage has a compacted flow communication position height H2; and ii) a final detachment position for enabling detachment of said liquid vial adapter from said drug vial adapter thereby providing repeatable access to said self-sealing access valve for aspiration of liquid drug contents from the drug vial, characterized in that the manual operable flow control arrangement has a further operative position comprising an initial extended set-up position in which said liquid vial adapter engages said drug vial adapter without said male connector being inserted into said female connector whereby said self-sealing access valve is closed and wherein the dual vial adapter assemblage has an initial extended set-up position height H1 where H2<H1, thereby said compacted flow communication position is an intermediate compacted flow communication position between said initial extended set-up position and said final detachment position.

2. The assemblage according to claim 1 wherein said flow control arrangement undergoes a linear compaction from said extended set-up position to said compacted flow communication position for urging said male connector into said female connector.

3. The assemblage according to claim 2 wherein said liquid vial adapter includes at least one inward directed hook member for sliding down an associated longitudinal track on said drug vial adapter during said linear compaction.

4. The assemblage according to claim 3 wherein said liquid vial adapter includes an upright cylindrical sleeve surrounding said male connector and said upright cylindrical sleeve is formed with said at least one inward directed hook member.

5. The assemblage according to claim 2 and further comprising a blister for containing the dual vial adapter assemblage, said blister including an open topped blister pack having a blister container closed end and a blister container open end, said blister container open end having an internal rigid restrainer arrangement for preventing immediate snap fit of said liquid vial adapter on the liquid vial on said telescopic mounting said liquid vial adapter on the liquid vial such that said telescopic mounting initially urges said flow control arrangement from said initial extended set-up position to said intermediate compacted flow communication position.

6. The assemblage according to claim 1 wherein said flow control arrangement undergoes a rotational compaction from said extended set-up position to said compacted flow communication position for urging said male connector into said female connector.

7. The assemblage according to claim 6 wherein said flow control arrangement is a bayonet arrangement having at least one pin groove pair in which a pin travels along an associated generally Y-shaped groove from a first closed end at said initial extended set-up position to a second closed end opposite said first closed end at said intermediate compacted flow communication position and from said second closed end at said intermediate compacted flow communication position to an open end at said final detachment position.

8. The assemblage according to claim 6 wherein said flow control arrangement is a bayonet arrangement having at least one pin groove pair in which a pin travels along an associated inverted inclined generally U-shaped groove from a first closed end at said initial extended set-up position to a curved apex at said intermediate compacted flow communication position and from said curved apex at said intermediate compacted flow communication to an open end at said final detachment position.

9. The assemblage according to claim 1 wherein said flow control arrangement employs a manual rotation of said liquid vial adapter relative to said drug vial adapter for disengaging said liquid vial adapter from said drug vial adapter at said final detachment position.

10. The assemblage according to claim 1 wherein, in said initial extended set-up position, said male connector contacts said self-sealing access valve without longitudinally compressing same.

* * * * *